US010485272B2

(12) United States Patent
Blauer et al.

(10) Patent No.: US 10,485,272 B2
(45) Date of Patent: Nov. 26, 2019

(54) BALLISTIC VEST CARRIER COVER WITH POUCHES FOR HARD ARMOR

(71) Applicant: Blauer Manufacturing Company, Inc., Boston, MA (US)

(72) Inventors: Stephen J Blauer, Lexington, MA (US); Robert K Lee, Cranston, RI (US)

(73) Assignee: Blauer Manufacturing Company, Inc., Boston, MA (US)

( * ) Notice: Subject to any disclaimer, the term of this patent is extended or adjusted under 35 U.S.C. 154(b) by 258 days.

(21) Appl. No.: 15/816,344

(22) Filed: Nov. 17, 2017

(65) Prior Publication Data

US 2018/0160744 A1 Jun. 14, 2018

Related U.S. Application Data

(63) Continuation-in-part of application No. 15/372,517, filed on Dec. 8, 2016, now Pat. No. 10,139,199, which is a continuation-in-part of application No. 15/015,442, filed on Feb. 4, 2016, now Pat. No. 9,835,414.

(Continued)

(51) Int. Cl.

| | |
|---|---|
| ***F41H 1/00*** | (2006.01) |
| ***A41D 1/04*** | (2006.01) |
| ***A41D 13/00*** | (2006.01) |
| ***F41H 1/02*** | (2006.01) |

(52) U.S. Cl.

CPC ..... *A41D 1/04* (2013.01); *A41D 13/0002* (2013.01); *F41H 1/02* (2013.01)

(58) Field of Classification Search

CPC ..... A41D 1/04

See application file for complete search history.

(56) References Cited

U.S. PATENT DOCUMENTS 345,899 A * 7/1886 Hill ..... A41D 1/04 2/92

2,747,190 A * 5/1956 Foster ..... F41H 1/02 2/2.5

(Continued)

FOREIGN PATENT DOCUMENTS

EP 1772697 A2 4/2007

OTHER PUBLICATIONS

American Body Armor, Uniform Carrier, 2009.

(Continued)

*Primary Examiner* — Khaled Annis

(74) *Attorney, Agent, or Firm* — Altman & Martin; Steven K Martin

(57) ABSTRACT

Hard armor plate pouches incorporated in a ballistic vest carrier cover that has armor panel pockets with side openings and waist panels. The pouches are attached to the carrier cover outer layer inside the armor pockets with access through the outer layer. The pouch is a single fabric sheet attached to the outer layer around the sheet perimeter, a bag that hangs freely in the pocket, or a bag that hangs in the pocket from the shoulders and neck opening of the cover. The front pouch has side and bottom lobes to ease installation of the armor plate. The pouch is accessed via a lateral or vertical opening in the outer layer that is closed by an openable fastener. Optionally, the waist panels have side pouches that have openings at the side or the top.

13 Claims, 28 Drawing Sheets

Related U.S. Application Data

(60) Provisional application No. 62/115,341, filed on Feb. 12, 2015.

(56) References Cited

U.S. PATENT DOCUMENTS 3,843,969 A 10/1974 George et al.
4,266,297 A 5/1981 Atkins
4,485,491 A 12/1984 Rusmussen
5,060,314 A * 10/1991 Lewis ..... A62B 17/003 2/2.5
5,073,985 A * 12/1991 Stone ..... F41H 1/02 2/2.5
5,157,792 A * 10/1992 Allen ..... F41H 1/02 2/2.5
5,331,683 A 7/1994 Stone et al.
5,570,473 A * 11/1996 Andries ..... A41D 3/00 2/108
5,584,737 A * 12/1996 Luhtala ..... A41D 13/0125 2/2.5
5,996,115 A * 12/1999 Mazelsky ..... F41H 1/02 2/2.5
6,066,017 A 5/2000 Max et al.
6,175,958 B1 * 1/2001 Wu ..... F41H 1/02 2/102
6,185,738 B1 * 2/2001 Sidebottom ..... F41H 1/02 2/102
6,526,862 B1 3/2003 Lyons
8,776,262 B2 7/2014 Blauer et al.
8,925,115 B1 * 1/2015 Hanna ..... F41H 1/02 2/102
2001/0050492 A1 12/2001 Janevski
2006/0037121 A1 2/2006 Park
2008/0235841 A1 10/2008 McDunn et al.
2008/0263737 A1 10/2008 Parks et al.
2010/0162459 A1 * 7/2010 Bronstein ..... F41H 1/02 2/2.5
2010/0205708 A1 * 8/2010 Storms, Jr. ..... A41D 13/05 2/2.5
2011/0023201 A1 * 2/2011 Pearl ..... F41H 1/02 2/2.5
2011/0209260 A1 9/2011 Herbener et al.
2012/0124713 A1 * 5/2012 Blauer ..... F41H 1/02 2/102
2012/0132066 A1 * 5/2012 Seuk ..... F41H 1/02 89/36.05
2012/0180205 A1 7/2012 Herring
2012/0180631 A1 * 7/2012 Sporn ..... F41H 5/0485 89/36.02
2012/0240300 A1 * 9/2012 Pittman ..... F41H 1/02 2/2.5
2013/0152290 A1 * 6/2013 Chou ..... A41D 13/0575 2/463
2014/0082809 A1 2/2014 Blauer et al.
2014/0130224 A1 * 5/2014 Lurio ..... F41H 1/02 2/2.5
2014/0201879 A1 * 7/2014 Seuk ..... F41H 1/02 2/2.5
2014/0259249 A1 * 9/2014 Milligan ..... F41H 1/02 2/2.5
2015/0341989 A1 * 11/2015 Modrzejewski ..... H05B 3/342 219/211
2016/0033235 A1 * 2/2016 Kinnings ..... F41H 1/02 2/102
2016/0138894 A1 * 5/2016 Heise ..... F41H 1/02 89/36.05
2016/0238347 A1 8/2016 Blauer et al.
2017/0082404 A1 3/2017 Blauer et al.

OTHER PUBLICATIONS

Point Blank Armor, Tailored Armor Carrier, 2010.
Diamondback Tactical, Viking Enforcer, 2014.
Armor Express, Lighthawk XT, 2013.
Protech Tactical, Titan Assault Enhanced, 2011.
Point Blank Enterprises, Plate Carrier, 2013.
Second Chance Body Armor, Tactical Assault Carrier, 2014.
Office Action for U.S. Appl. No. 13/367,262 dated Apr. 12, 2013.
Office Action for U.S. Appl. No. 14/093,243 dated Jan. 31, 2014.
Office Action for U.S. Appl. No. 15/015,442 dated Jun. 28, 2017.

* cited by examiner

BALLISTIC VEST CARRIER COVER WITH POUCHES FOR HARD ARMOR

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to police equipment, more particularly, to outer carrier wearing of soft body armor, law enforcement duty belts and methods for suspending them.

2. Description of the Related Art

Standard equipment for peace officers includes the wearing of an undershirt or turtleneck, a ballistic soft body armor vest, and a police uniform shirt over the vest. The body armor vest includes a carrier, two armor panels, and attachable/detachable fasteners, typically hook and loop fasteners. One armor panel fits into a front carrier through an opening in the bottom of the front carrier and the other armor panel fits into a rear carrier through an opening in the bottom of the rear carrier. The attachable/detachable fasteners attach the front and rear carriers together around the wearer's waist and over the shoulders to form the vest.

The body armor vest traps excess body heat around the torso in warm weather and is uncomfortable due to the constant compression and weight of the armor. It is also very inconvenient to remove the body armor carrier prior to the conclusion of the wearer's shift. For this reason there has been a move towards the wearing of outer carrier ballistic vests.

Most outer carrier vests are made from heavy-duty nylon or polyester materials and are fitted to a particular brand of soft body armor panels. The panels are removed from the front and rear carriers and inserted into the bottom of the carrier vest. The carrier vest has attachable/detachable, typically hook and loop, fasteners at the sides for adjustment and removal. Use of the carrier vest's fasteners rather than those supplied by the manufacturer with the body armor panels may void the armor warranty. The carrier vests are made to somewhat match the look of a uniform shirt on the outside and are typically worn over a police shirt. The carrier vest is independent from the duty belt and sits above it on the torso.

There are occasional situations where additional armor protection is desired. The additional protection can take the form of hard armor plates covering the front and rear torso. Typically, the hard armor plates are installed in a separate carrier and donned when needed. The extra bulk from the plate carrier can further restrict the movements of the wearer.

BRIEF SUMMARY OF THE INVENTION

The present invention is a front pouch, a rear pouch, and optional side pouches for hard armor plates incorporated into any ballistic vest carrier cover.

Briefly, the carrier cover has a mantle that goes over the wearer's shoulders from a front panel at the front waist to rear panel at the rear waist. The mantle has a fabric outer layer, an optional interlining to protect the outer layer from abrasion from the body armor panel carriers, and a liner that is typically a polyester mesh.

The liner is attached to the outer layer to form a front pocket and a rear pocket that receive the body armor panel carriers. Side armor openings and optional lateral openings provide access to the pockets. The armor openings allow the use of the body armor waist straps that are supplied with the body armor for individual adjustment. The front and rear panel carriers are attached together at the shoulders using the body armor shoulder straps supplied with the body armor.

Waist panels extend from the lower end of the rear panel at the armor openings, over the waist straps, and detachably attach at the front panel armor openings. The waist panels are preferably composed substantially of a stretch fabric and detachably attach to the front panel any type of detachable fasteners, preferably zippers.

The present invention incorporates a front pouch and/or a rear pouch into a carrier cover of any type. The front and rear pouches are inside the front and rear armor pockets, respectively, with access from the outside of the carrier cover. The present invention also contemplates the optional incorporation of side pouches in the side panels of the carrier cover.

In one configuration, the pouch is attached to the inside of the outer layer within the pocket. The pouch is a single fabric sheet that is attached to the outer layer around the sheet perimeter. In another configuration, the pouch is a bag that hangs in the pocket. The upper edges of the bag are attached to the outer layer so that the bag hangs freely within the pocket. In another configuration, the pouch is a bag closed on top that hangs from the shoulders within the pocket. Optionally, the bottom end of the bag is tacked to the outer layer. Optionally, the front pouch has side and bottom lobes to facilitate installation of the front armor plate.

In one configuration, the top end of the pouch is accessed via a lateral opening in the outer layer. The lateral opening is closed by a openable fastener, such as a zipper, hook and loop fastener, or snaps. In another configuration, the front pouch is accessed via a vertical opening in the outer layer that is closed by an openable vertical fastener, such as a zipper, hook and loop fastener, or snaps. Optionally, the opening and fastener are hidden behind or on the edge of a placket.

In one embodiment, the pouches are sized to accept one size of armor plate so they do not slide around inside the pouches. In another embodiment, the pouches can be used with a variety of armor plates having different widths. The pouches have internal vertical sizing strips that are strips of detachable fasteners, preferably hook and loop fasteners or snaps. The sizing strips come in opposed pairs so that the armor plate is kept centered.

In another embodiment, the pouches can be used with a variety of armor plates having different thicknesses. The pouch is sized for the thickest plate and internal loop fasteners mate to a corresponding hook fastener on the thinner plates.

Optionally, there are side pouches in the waist panels for side armor plates. In one configuration, the waist panel has an outer layer and an inner layer that are attached at the top edge, bottom edge, rear edge, and the lower portion of the front edge, forming the pouch and a vertical side armor pouch opening. The lower portion extends upwardly far enough so that the side armor plate does not fall out after being installed.

In another configuration, the outer and inner layers are attached around the edges, forming the pouch. The top end of the side pouch is accessed via a lateral opening in the outer layer that is closed by an openable fastener, such as a zipper, hook and loop fastener, or snaps.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present application hereby incorporate by reference in their entirety U.S. patent application Ser. Nos. 15/015,442 and 15/372,517, and U.S. Provisional Patent Application No. 62/115,341, on which this application is based.

The present invention is a front pouch, a rear pouch, and optional side pouches for hard armor plates incorporated into a ballistic vest carrier cover.

The present invention contemplates that the pouches can be incorporated into any carrier cover. One such carrier cover is described in U.S. Pat. Nos. 8,528,112 and 8,776,262, incorporated herein by reference.

Figure 1:
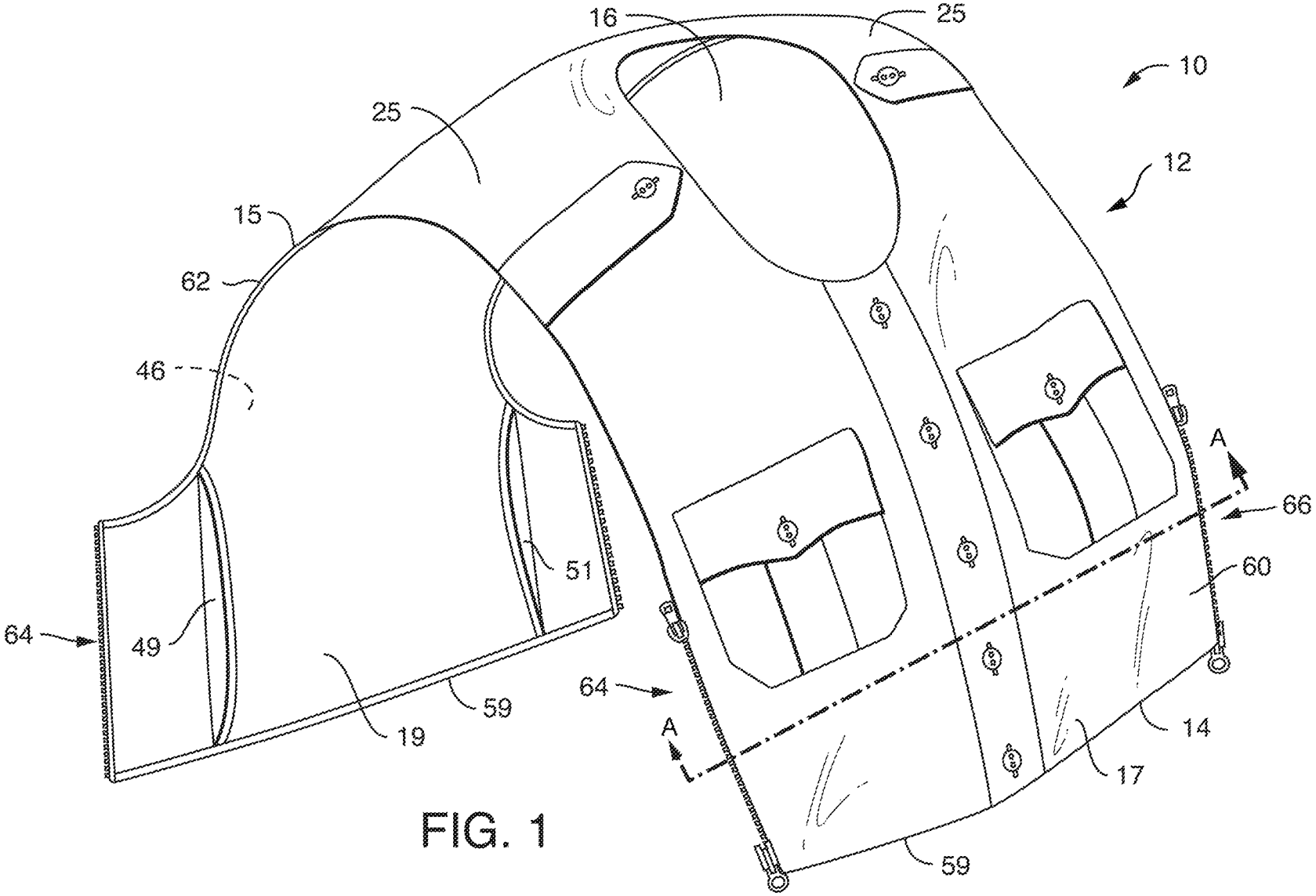
FIG. 1 is a perspective view of the ballistic vest carrier cover of the present invention.
Figure 2:
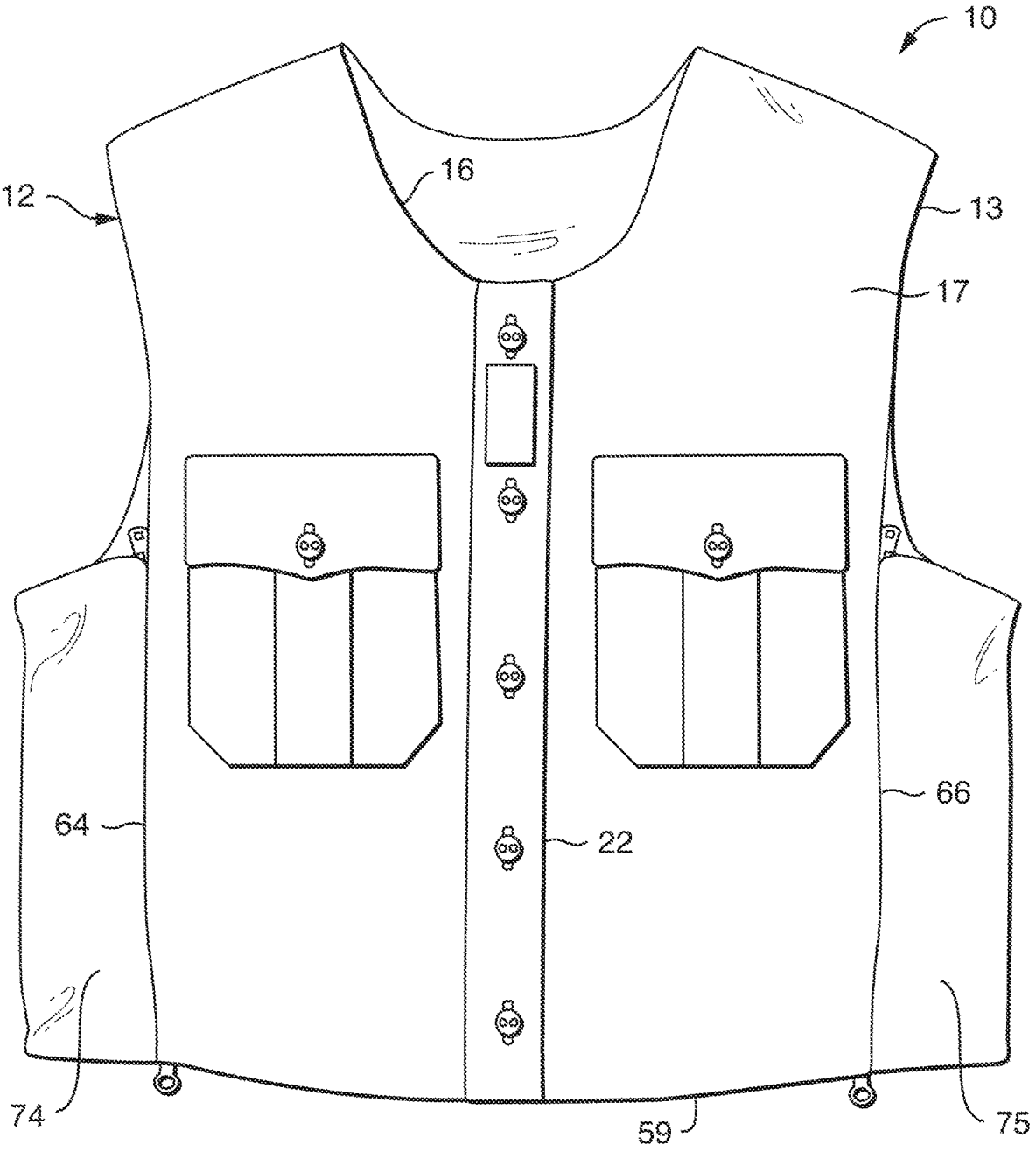
FIG. 2 is a front view of the carrier cover of FIG. 1 showing several options.
Figure 3:
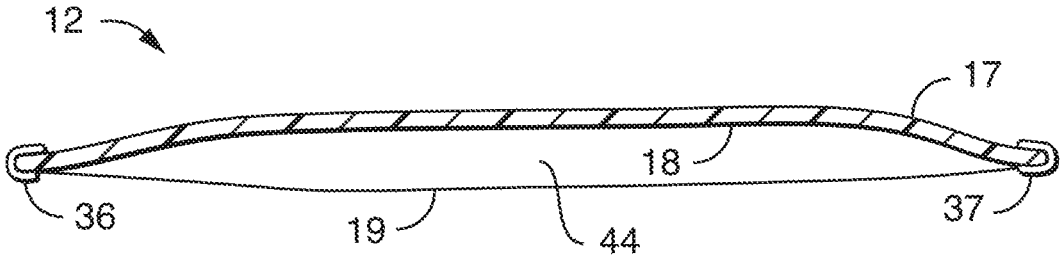
FIG. 3 is a cross-sectional view of one fabric structure of the carrier cover of FIG. 1 taken at A-A.
Figure 4:
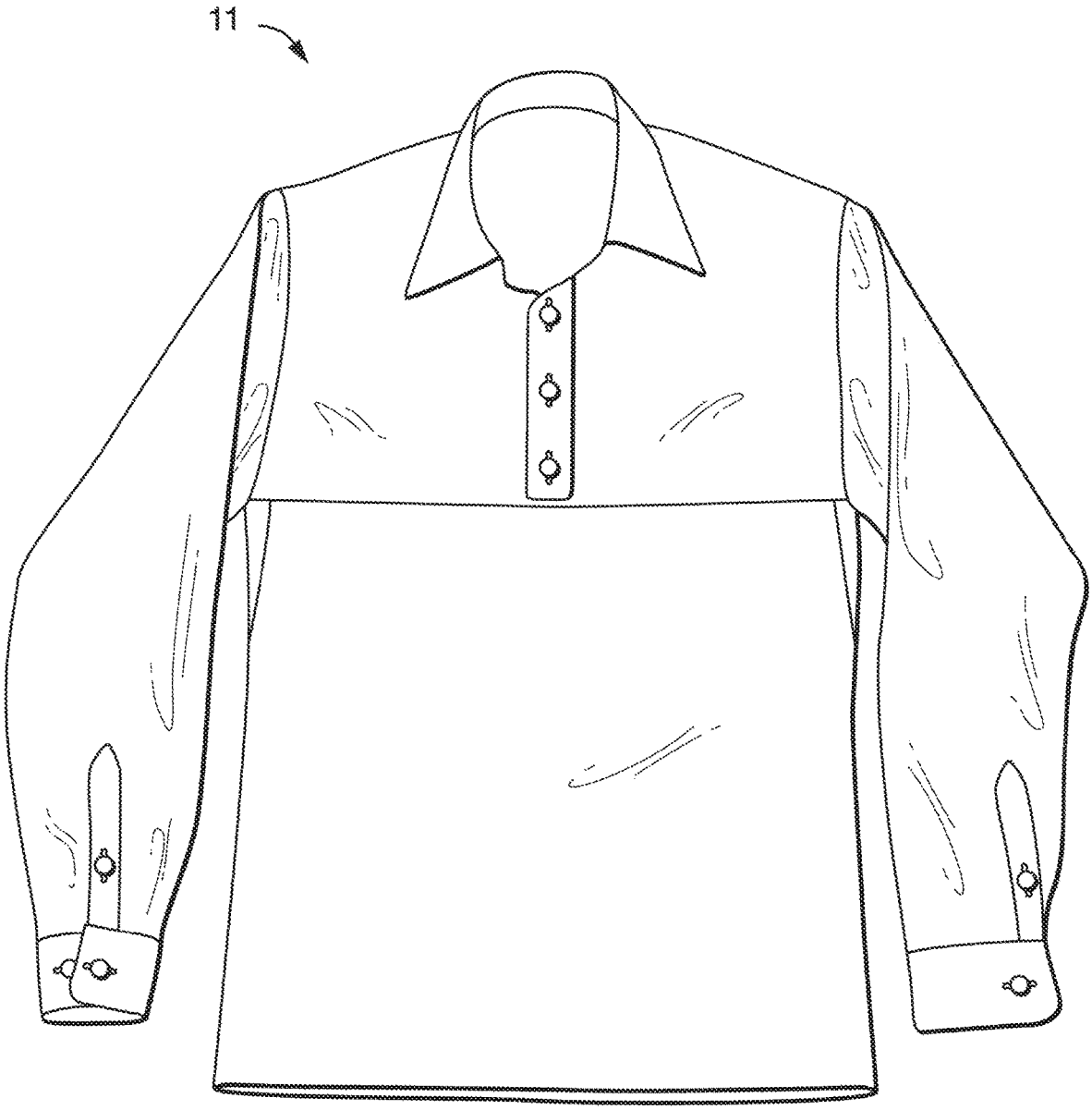
FIG. 4 is a perspective view of a long-sleeve pullover shirt for use with the carrier cover of the present invention.

As shown in FIGS. 1 and 2, the carrier cover 10 has a mantle 12 that goes over the wearer's shoulders from the front waist to rear waist and with a neck opening 16 that goes over the head. The mantle 12 includes a front panel 60 and a rear panel 62. The mantle 12 has a fabric outer layer 17, an optional interlining 18, and a liner 19, as shown in FIG. 3. The carrier cover 10 is typically designed to fit over a matching shirt 11, as shown in FIG. 4. From a distance and at first glance, the combination of carrier cover 10 and shirt 11 are intended to appear as a standard uniform shirt. The combination preserves the officers tactical advantage gained by wearing "concealed" armor that is more comfortable to wear versus most outer carriers which do not match the shirts they are worn over.

The optional interlining 18 attached to the outer layer 17 protects the outer layer 17 from abrasion from the body armor panel carriers 40, 42, thereby providing strength and durability to the carrier 10.

The liner 19 is composed of a knit or woven material that may be wicking or non-wicking in performance. Typically, the majority of the liner 19 is a heavyweight polyester mesh.

Figure 5:
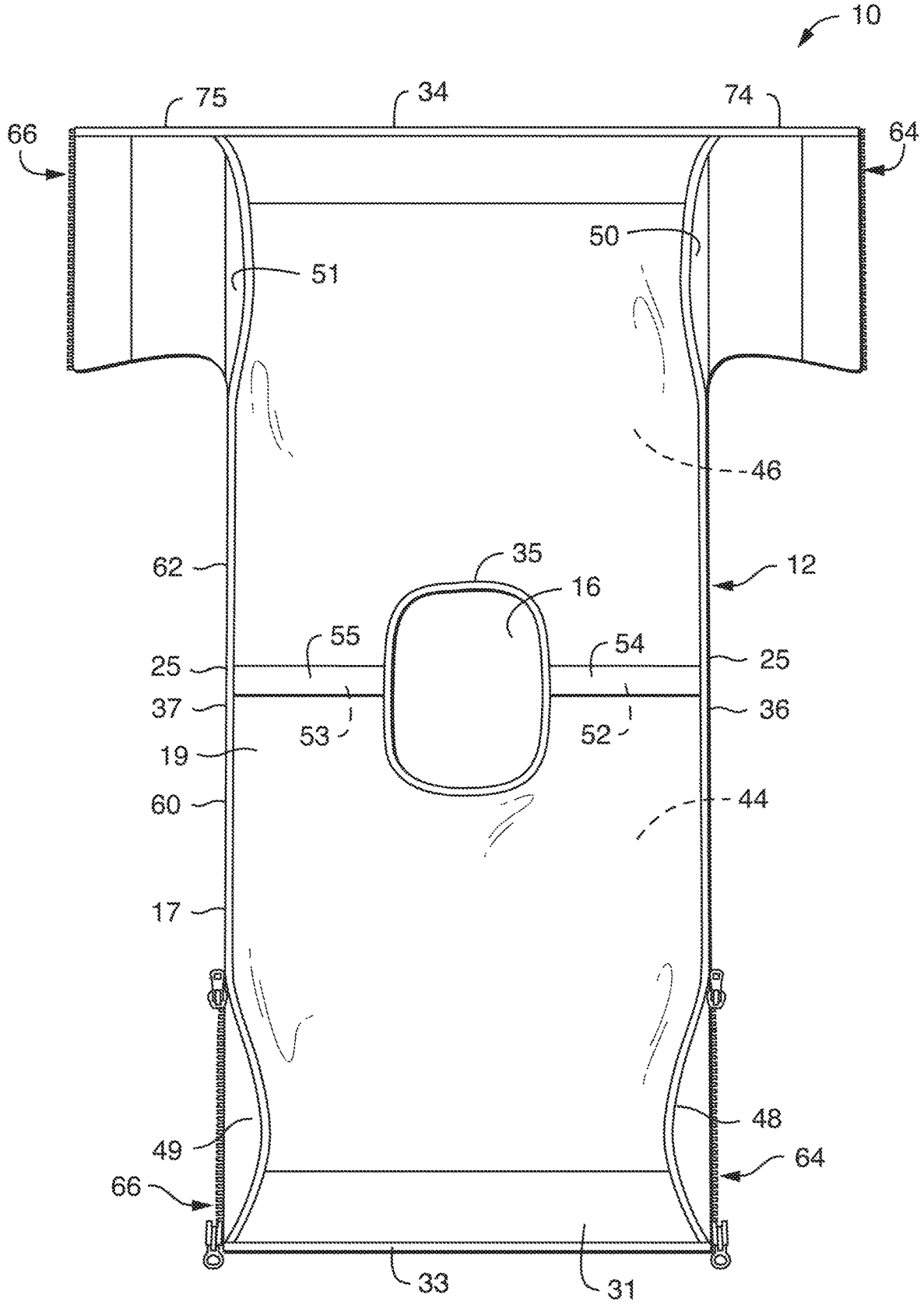
FIG. 5 is a view of the inside of the carrier cover of FIG. 1.

The liner 19 is attached to the outer layer 17 at several places, as shown in FIG. 5. The layers 17, 19 are attached at the front waist, as at 33, at the rear waist, as at 34, at the neck opening 16, as at 35, along the right side from a right front armor opening 48 adjacent to the front waist 33 to right rear armor opening 50 adjacent to the rear waist 34, as at 36, and along the left side from a left front armor opening 49 adjacent to the front waist 33 to left rear armor opening 51 adjacent to the rear waist 34, as at 37. The front armor openings 48, 49 are separated by the front waist attachment 33, and the rear armor openings 50, 51 are separated by the rear waist attachment 34. The attachments 33-37 can be stitched and reinforced with durable fabrics, such as polyester or nylon, to prevent abrasion and wear.

Figure 6:
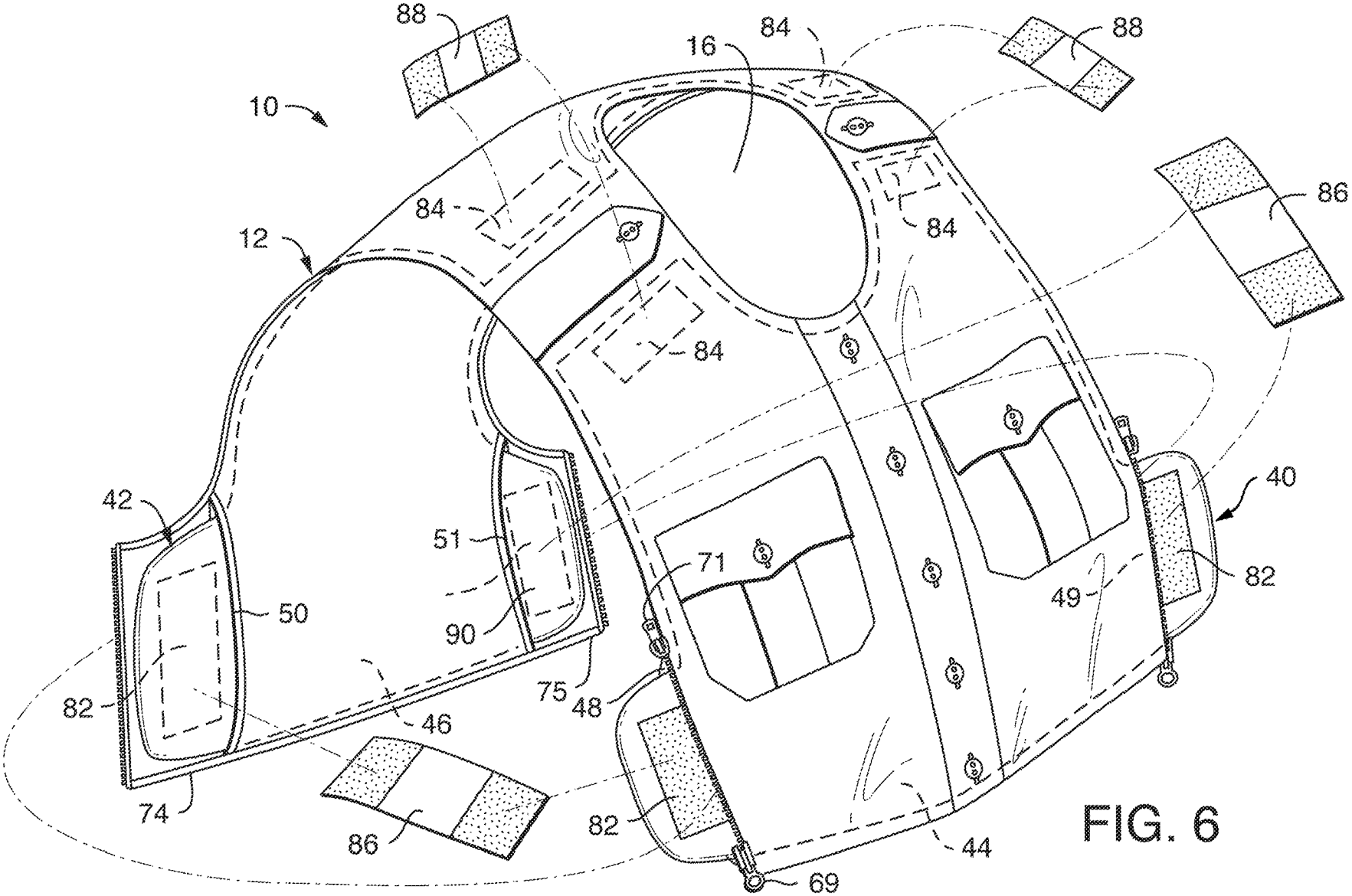
FIG. 6 is a perspective view of the carrier cover of FIG. 1 with body armor carriers installed.
Figure 7:
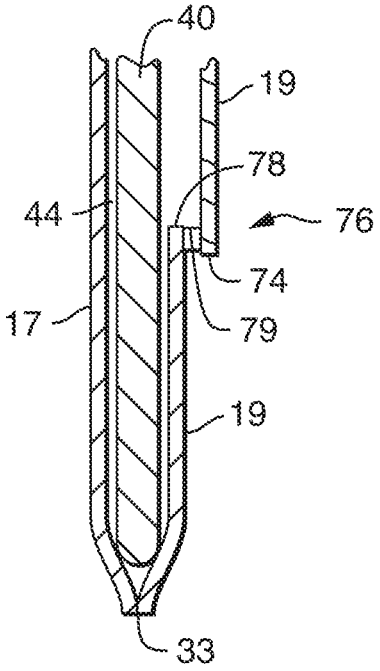
FIG. 7 is a side cross-sectional view of the bottom opening for installing the armor carrier.

Because the outer layer 17 and liner 19 are only attached at the edges, two pockets are formed, a front pocket 44 and a rear pocket 46, between the outer layer 17 and liner 19 for receiving the body armor panel carriers 40, 42, as shown in FIG. 6. Openings 48-51 between the waist attachments 33, 34 and the ends of the side attachments 36, 37 provide access to the pockets 44, 46 for installing and removing the armor panel carriers 40, 42.

Optionally, and in addition to the side openings 48-51, the present invention contemplates that there may be lateral openings 76 in the liner 19 for inserting the armor panel carriers 40, 42 into the pockets 44, 46. Either the front, the rear, or both the front and rear can have a lateral opening 76. In one configuration, the waist attachments 33, 34 are zippers, hook and loop fasteners, or other openable fasteners that facilitate inserting the armor panel carriers 40, 42 into the pockets 44, 46 from the bottom. In another configuration, the lateral opening 76 is formed by overlapping edges 77, 78 of the liner 19, as in FIG. 8. The edges 77, 78 are closed by a zipper, a hook and loop fastener, or other openable fastener 79.

The armor openings 48-51 allow the use of the body armor waist straps 86 that are supplied with the body armor for individual adjustment. Each waist strap fastener 88 attaches to a mating hook and loop fastener 82 on the body armor panel carrier 40, 42, while extending around the wearer's side.

Optional tunnels 52, 53 at each shoulder between the front pocket 44 and the rear pocket 46 allow fastening of the front and rear armor panel carriers 40, 42. Optional openings 54, 55 in the liner 19 at the shoulders 25 facilitate attaching the two armor panel carriers 40, 42 together at the shoulders 25 using the body armor shoulder straps 88 supplied with body armor. Each shoulder strap fastener 88 attaches to a mating hook and loop fastener 84 on the body armor panel carriers 40, 42, while extending over the wearer's shoulder.

Waist panels 74, 75 extend from the lower end of the rear panel 62 at the armor openings 50, 51. The waist panels 74, 75 allow for improved ventilation, better fit, and freer motion, and are preferably composed substantially of a stretch fabric. The amount of stretch is significantly more than what is considered a non-stretch material. The present invention considers that a material that increases in length by at least 8% when under tension is a stretch material. The waist panels 74, 75 help hide the body armor panel carriers 40, 42 and body armor straps 86 outside of the pockets 44, 46, thereby facilitating the illusion of a standard uniform shirt.

The waist panels 74, 75 removably attach to the front panel 60 by detachable panel fasteners 63, 64. Any type of detachable fasteners can be used including hook and loop fasteners, snaps, buckles, and hook and eye closures. The preferred panel fasteners 63, 64 are zippers 65, 66 because they are difficult to remove during an altercation.

Hard armor plates are well-known in the industry. They are rigid plates, typically made of coated steel, ceramic, polyethylene, or carbon composites. Front armor plates are made to cover the front torso, rear armor plates are made to cover the rear torso, and side armor plates are made to cover the side rib cage. The front and rear armor plates are generally contoured to fit the front and rear torso of a wearer and come in a range of sizes, typically from 8"×10" to 11"×14". They are also found in a range of thickness, ranging from ¼" to 1¼". Various combinations of materials and thicknesses provide for a wide range of available protection levels. Side armor plates typically have a single curve to hug the body. They come in a range of sizes from 6"×6" to 8"×10" and in thicknesses from ½" to 1¼".

The present invention incorporates a front pouch 102 and/or a rear pouch 104 into a carrier cover 10 of any type. The front pouch 102 is inside the front armor pocket 44 with access from the outside of the carrier cover 10 to facilitate quick installation of a front armor plate 92. The rear pouch 104 is inside the rear armor pocket 46 with access from the outside of the carrier cover 10 to facilitate quick installation of a rear armor plate 94.

The present invention also contemplates the optional incorporation of side pouches 106, 108 in the side panels 74, 75 of the carrier cover 10 with access from the outside of the carrier cover 10 to facilitate quick installation of side armor plates 96, 98.

Figure 8:
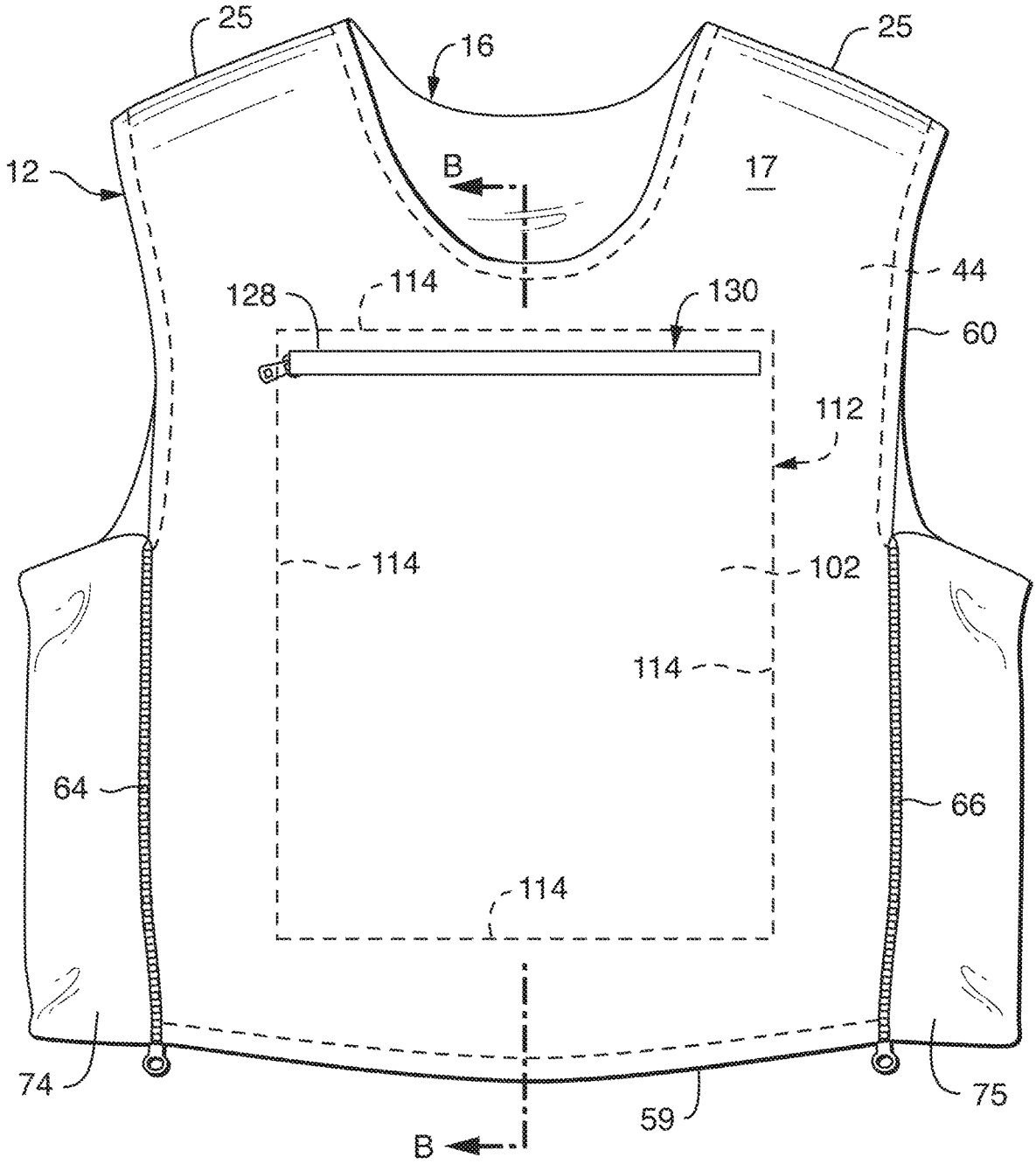
FIG. 8 is a front view of a carrier cover showing the front armor pocket and the single sheet front armor pouch in phantom with a lateral opening.
Figure 9:
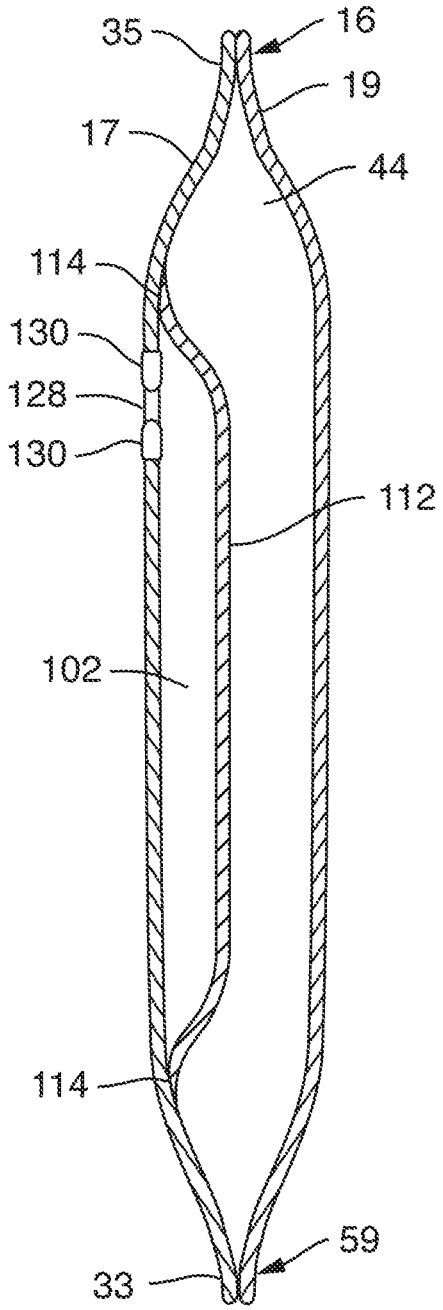
FIG. 9 is a side cross-sectional view of FIG. 8 taken at B-B of the front armor pocket and the single sheet embodiment of the front armor pouch with the lateral opening.

One configuration of the front pouch 102 is shown in FIGS. 8 and 9. The front pouch 102 is attached to the inside of the outer layer 17 within the pocket 44. The front pouch 102 is a single fabric sheet 112 that is attached to the outer layer 17 around the sheet perimeter 114. The single sheet 112 is attached only to the outer layer 17 so it does not interfere with installation of the front armor carrier 40 into the front pocket 44. In reference to the incorporated pouch, the outer layer 17 is intended to include any interlining 18 that may be attached to the outer layer 17.

Figure 10:
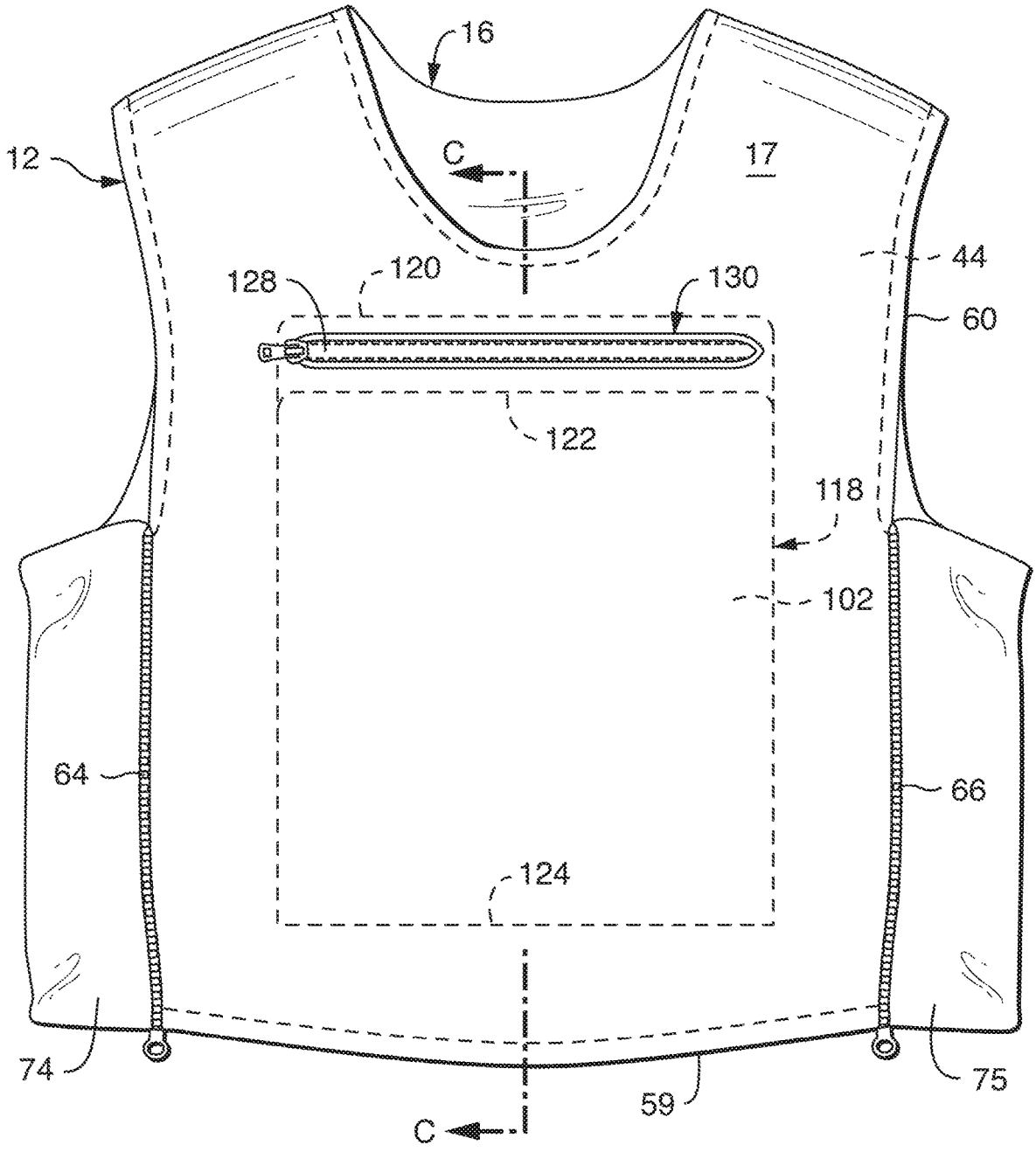
FIG. 10 is a front view of a carrier cover showing the front armor pocket and the first configuration of the bag front armor pouch in phantom with a lateral opening.
Figure 11:
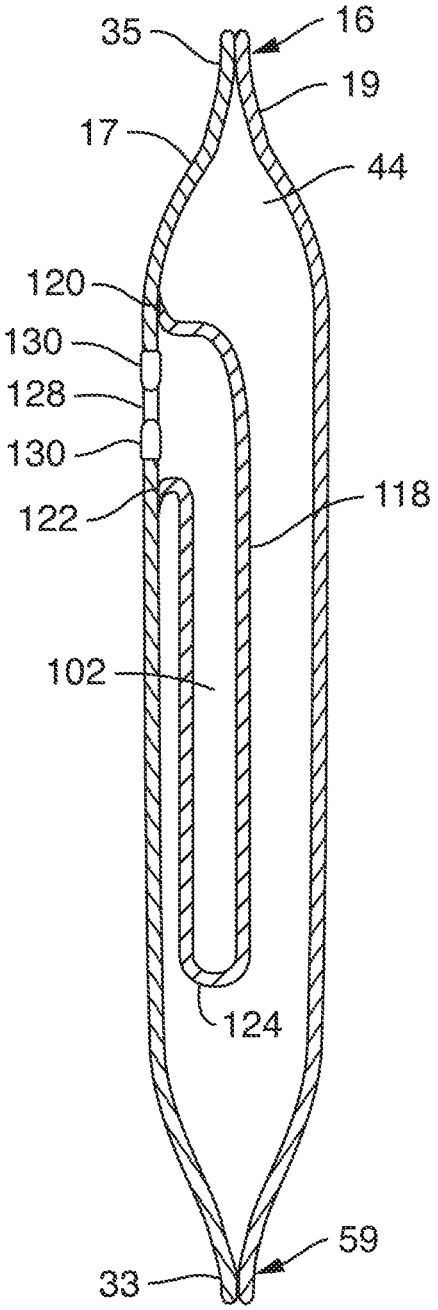
FIG. 11 is a side cross-sectional view of FIG. 10 taken at C-C of the front armor pocket and the bag front armor pouch with the lateral opening.

In another configuration, shown in FIGS. 10 and 11, the front pouch 102 is a bag 118. The upper edges 120, 122 of the bag 118 are attached to the outer layer 17 so that the bag 118 hangs freely within the front pocket 44. Optionally, the bottom end 124 of the bag 118 is tacked to the outer layer 17 so that it does not fold or otherwise crease in a way that prevents easy installation of the front armor plate 92, as described below, interfere with installation of the front armor carrier 40 into the front pocket 44. As with the single sheet 112, the bag 118 is attached only to the outer layer 17 so it does not interfere with installation of the front armor carrier 40.

Figure 12:
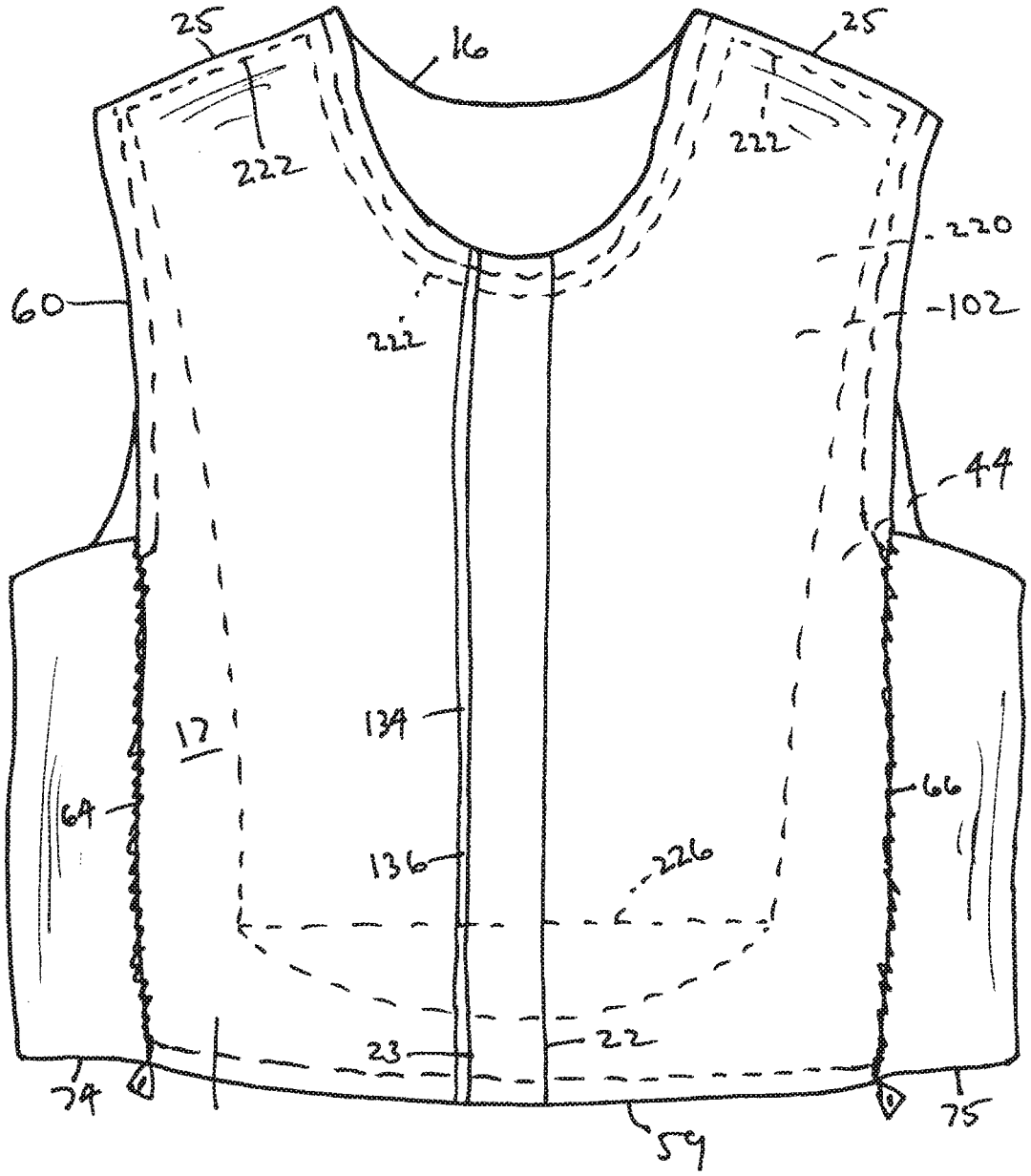
FIG. 12 is a front view of a carrier cover showing the front armor pocket and the second configuration of the bag front armor pouch in phantom with a vertical opening.

In another configuration, shown in FIG. 12, the front pouch 102 is a bag 220 that is closed at the top. The upper end 222 of the bag 220 is attached at the shoulders 25 and neck opening 16 so that the bag 220 hangs within the front pocket 44. The bottom end 224 of the bag 220 is sewn to the outer layer 17, as at 226, so that the bag 220 does not fold or otherwise crease in a way that prevents easy installation of the front armor plate 92, as described below, or interfere with installation of the front armor carrier 40 into the front pocket 44.

In one embodiment, as shown in FIGS. 8-11, the top end of the front pouch 102 is accessed via a lateral front opening 128 in the outer layer 17 that extends across the front panel 60 high on the chest. The lateral front opening 128 is closed by an openable front fastener 130, such as a zipper, hook and loop fastener, or snaps.

If the pouch embodiment of FIG. 12 has a lateral front opening like that of FIG. 10, the bag 220 has a lateral slit in the side at the location of the lateral front opening 128. The edges of the slit are sewn to the outer layer 17 at the lateral front opening 128 and the lateral front fastener 130.

Figure 13:
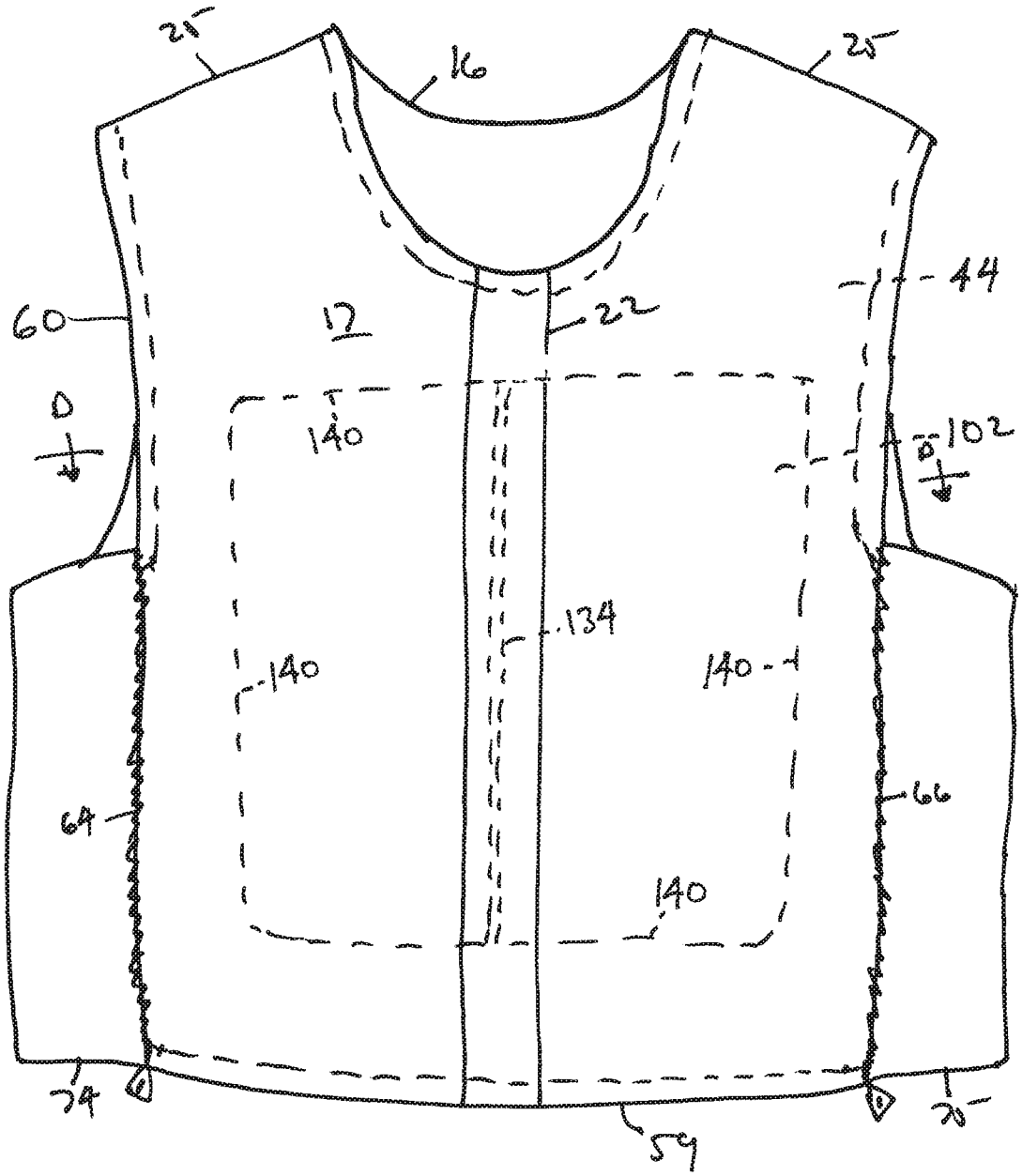
FIG. 13 is a front view of a carrier cover showing the front armor pocket and the single sheet front armor pouch in phantom with a vertical opening.
Figure 14:
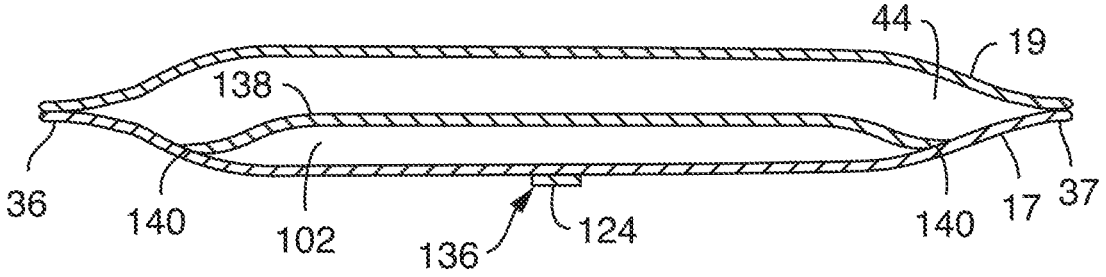
FIG. 14 is a top cross-sectional view of FIG. 13 taken at D-D of the front armor pocket and the single sheet front armor pouch with the vertical opening.

In another embodiment, the front pouch 102 is accessed via a vertical front opening 134, as shown in FIGS. 12-14 and 29. The vertical front opening 134 in the outer layer 17 extends vertically along the front panel 60 from at or just below the neck opening 16 to or just above the waist 59, preferably at or near the center of the front panel 60. The vertical front opening 134 is closed by a vertical openable front fastener 136, such as a zipper, hook and loop fastener, or snaps. Optionally, as shown in FIG. 13, the vertical front opening 134 and the vertical front fastener 136 are hidden behind a placket 22. The placket 22 is pulled aside for access to the vertical front fastener 136 and vertical front opening 134. Optionally, the vertical front opening 134 and vertical front fastener 136 are located at the edge 23 of a placket 22, as shown in FIG. 12. Optionally, the vertical front fastener 136 is a style of zipper called a hidden zipper.

In the embodiment of FIG. 12, in order to access the front pouch 102, the bag 220 has a vertical slit in the side at the location of the vertical front opening 134. The edges of the slit are sewn to the outer layer 17 at the vertical front opening 134 and the vertical front fastener 136.

In most situations, the wearer will want to install the armor plates quickly without taking the carrier cover 10 off. However, with the generally rectangular front pouch 102 of FIGS. 8-14 in combination with a vertical opening 134 of FIGS. 12 and 13, a thick armor plate is typically very difficult to install without taking the carrier cover 10 off. The present invention solves this problem by forming the front pouch 102 in a particular shape, shown in FIG. 29.

The front pouch 102 is a bag 230 that is closed at the top. The upper end 232 of the bag 230 is attached at the shoulders 25 and neck opening 16 so that the bag 230 hangs within the front pocket 44. The bottom 234 of the bag 230 has a side lobe 236 that distends the lower side of the bag 230 outwardly and a bottom lobe 238 that distends the bottom 234 of the bag 230 adjacent to the side opposite the side lobe 236 downwardly. A plate support 240 extends horizontally into the bag 230 from the side of the bag 230 opposite the side lobe 236 and is aligned with the section 250 of the bottom 234 of the bag 230 at the side lobe 236 between the side lobe 236 and the bottom lobe 238. The plate support 240 in combination with the section 250 of the bottom 234 provides a floor to support the armor plate 92, as described below.

Figure 29:
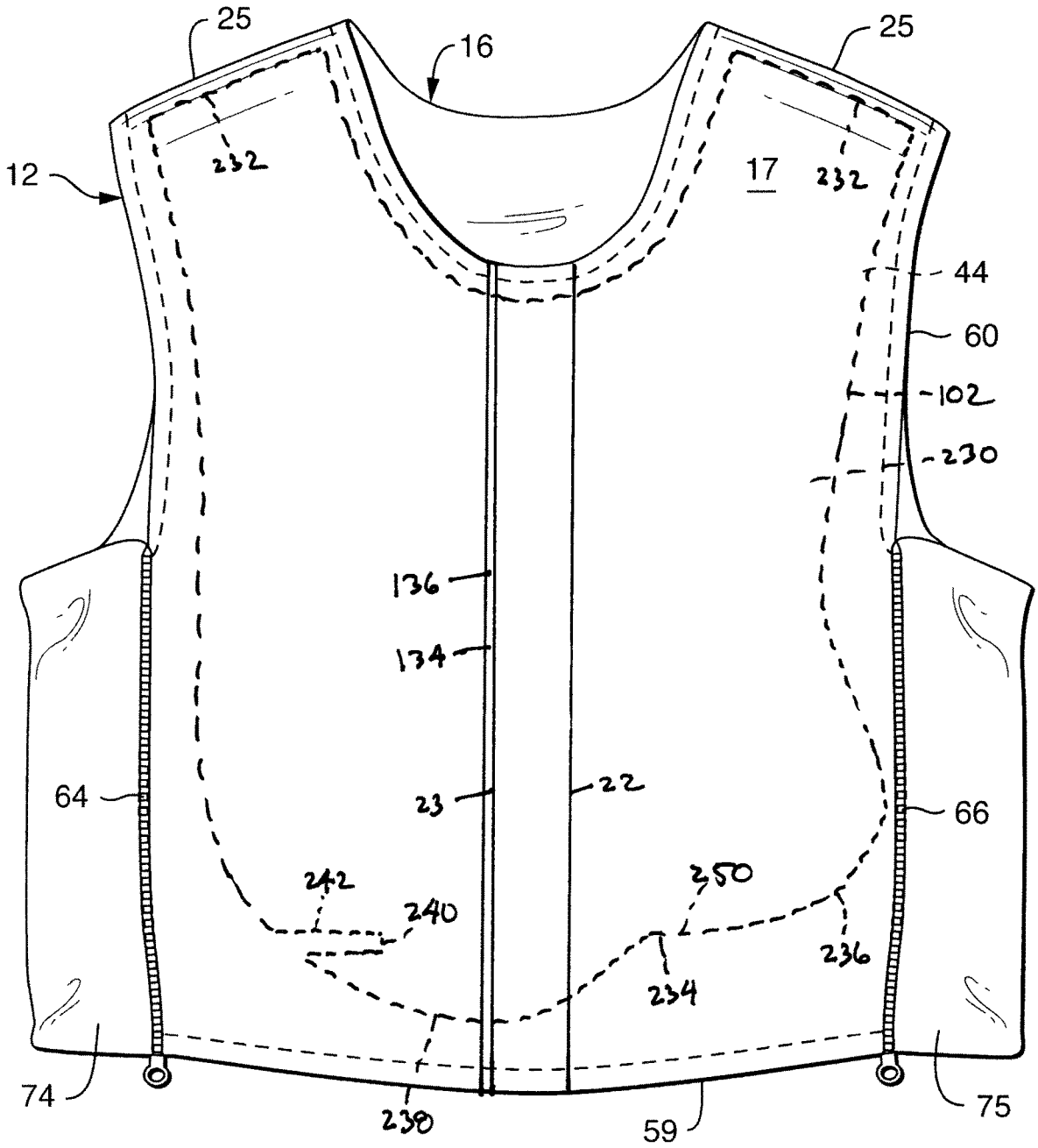
FIG. 29 is a front view of a carrier cover showing the front armor pocket and the shaped bag front armor pouch in phantom with a vertical opening.

The plate support 240 can be a single stitched line or can include other elements for strength. In FIG. 29, the plate support 240 includes a length of ribbon for strength and appears as a notch.

The notch 240 and, optionally, the bottom 234 of the bag 230 are sewn to the outer layer 17 so that the bag 230 does not fold or otherwise crease in a way that prevents easy installation of the front armor plate 92. Also, sewing the notch 240 to the outer layer 17 provides support for the armor plate 92, as described below.

This shape facilitates easy installation of the front armor plate 92 while wearing the carrier cover 10, as described below.

FIG. 29 shows the side lobe 236 on the left side of the bag 230 and the bottom lobe 238 and notch 240 on the right side. The present invention contemplates that the mirror image can also be implemented.

The pouch shape of FIG. 29 can also be adapted to the single sheet pouch of FIGS. 8 and 9 and the bag pouch of FIGS. 10 and 11.

Figure 15:
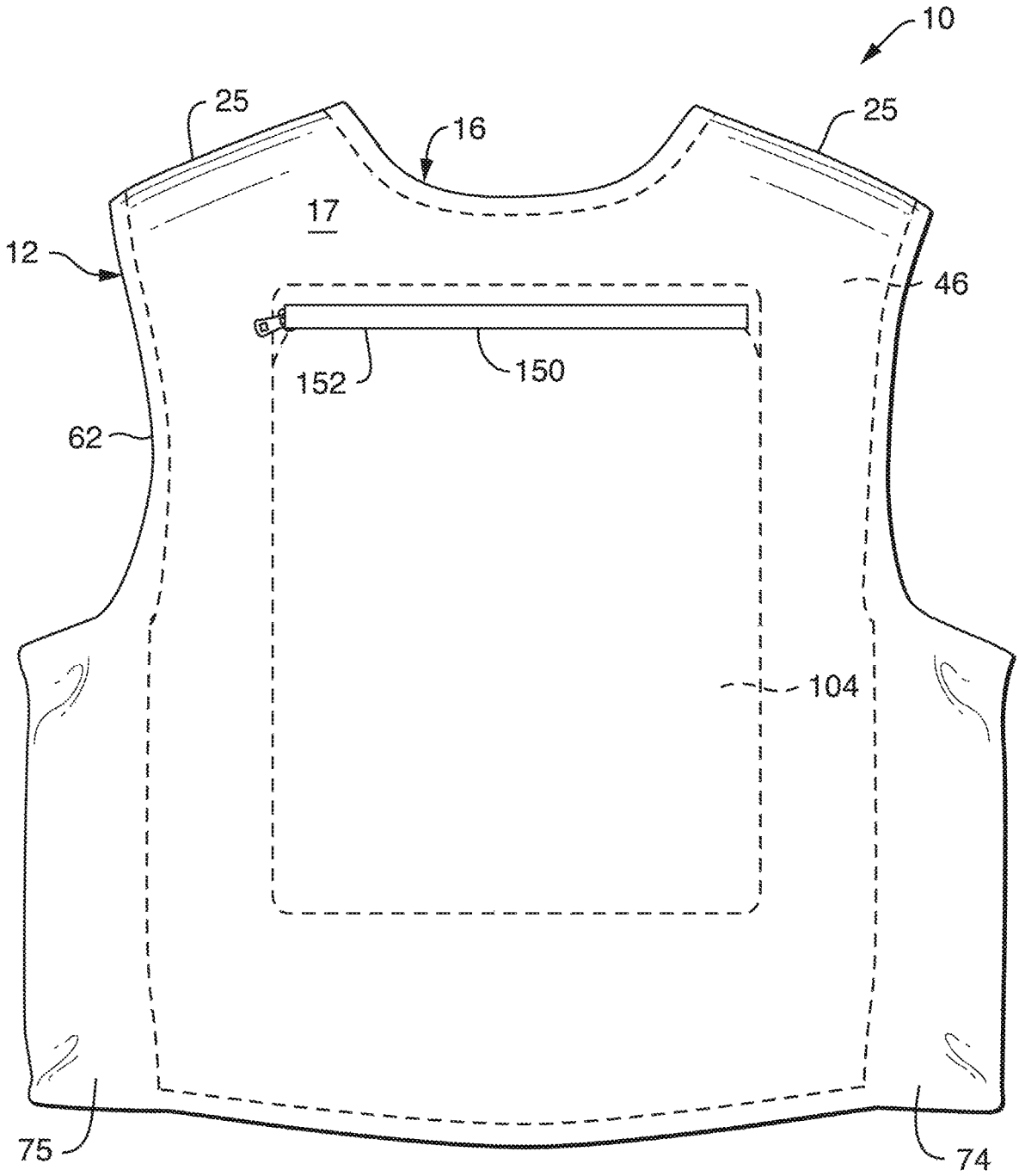
FIG. 15 is a rear view of a carrier cover showing the rear armor pocket and the sheet rear armor pouch in phantom.
Figure 16:
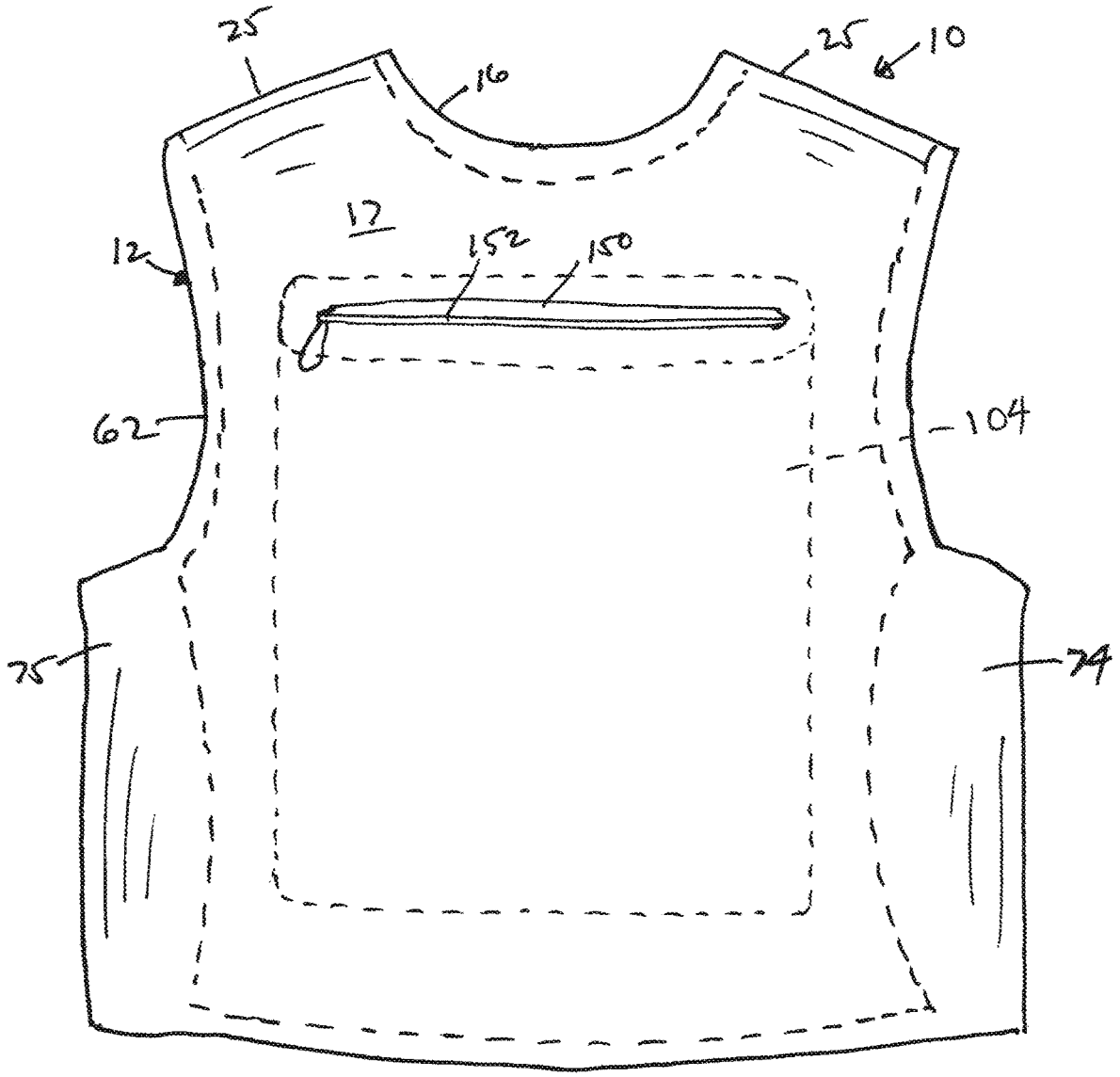
FIG. 16 is a rear view of a carrier cover showing the rear armor pocket and the first configuration of the bag rear armor pouch in phantom.
Figure 17:
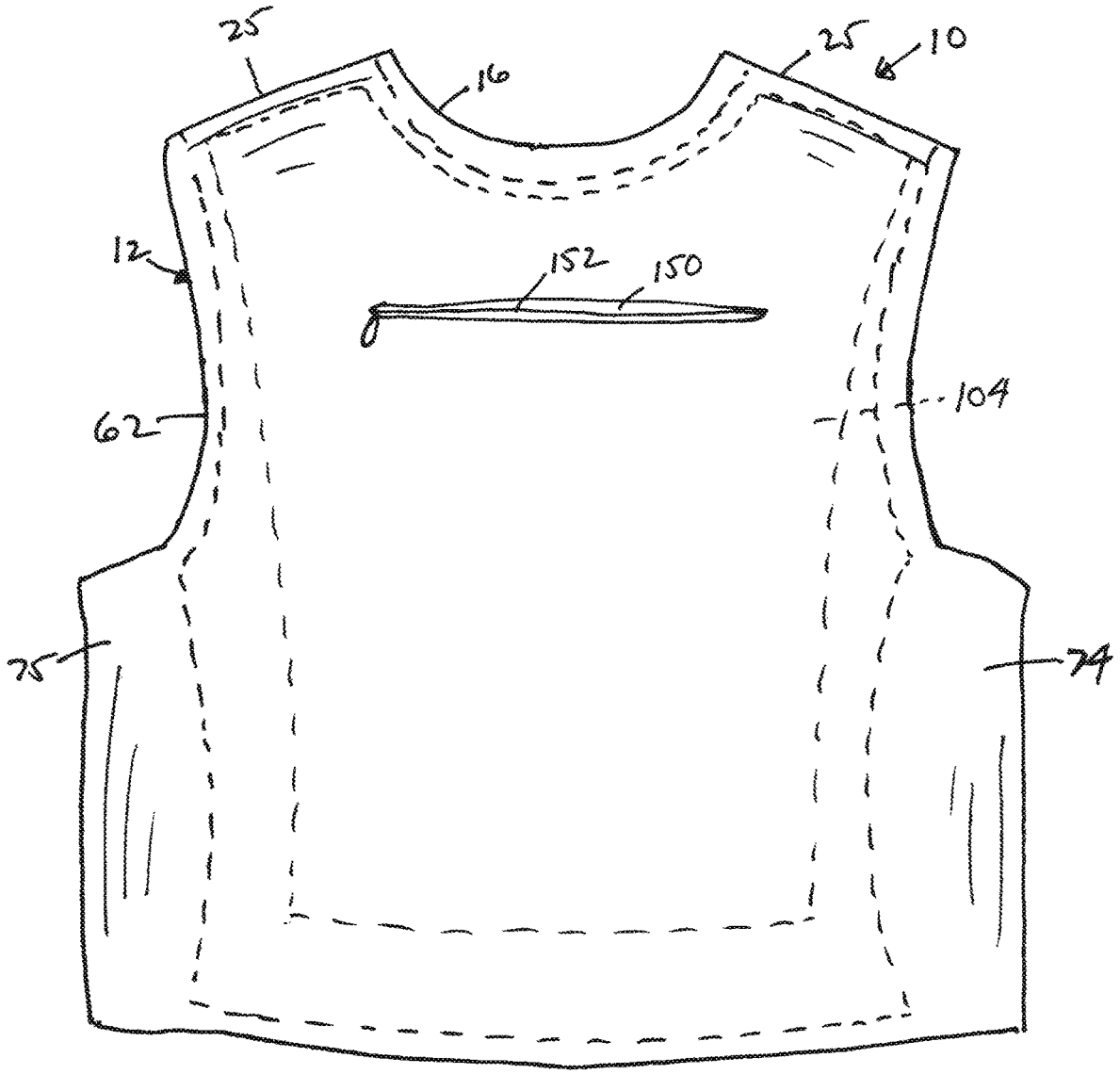
FIG. 17 is a rear view of a carrier cover showing the rear armor pocket and the second configuration of the bag rear armor pouch in phantom.

The rear pouch 104 is shown in FIGS. 15-17. The rear pouch 104 can take either the single sheet form shown in FIG. 15, the bag form shown in FIG. 16, or the bag form shown in FIG. 17, all of which are described above with reference to the front pouch 102.

A lateral rear opening 150 in the outer layer 17 extends across the rear panel 62 high on the back, just below the neck opening 16. The lateral rear opening 150 is closed by an openable rear fastener 152, such as a zipper, a hook and loop fastener, or snaps.

In the embodiment of FIG. 17, in order to access the rear pouch 104, the bag has a lateral slit in the side at the location of the lateral rear opening 150. The edges of the slit are sewn to the outer layer 17 at the lateral rear opening 150 and the lateral rear fastener 152.

The sheet 112, 138 or bag 118, 220 of the front and rear pouches 102, 104 are composed of a fabric material that is robust enough to handle the weight and abrasion from armor plates 92, 94. Materials include coated nylon and nylon and polyester meshes.

Optionally, the strength of the lower portion, for example, the lower third, of the bag 118, 220 is reinforced by, for example, an additional layer of material, a thicker material, a fiber-reinforced material, or a coating. The reinforcement helps prevent tears and other wear that may be caused by dropping the heavy plate 92, 94 into the bag 118, 220.

In one embodiment, the pouches 102, 104 are intended for use with a single size and thickness of armor plates 92, 94, and are sized accordingly so that the armor plates 92, 94 do not slide around inside the pouches 102, 104.

Figure 18:
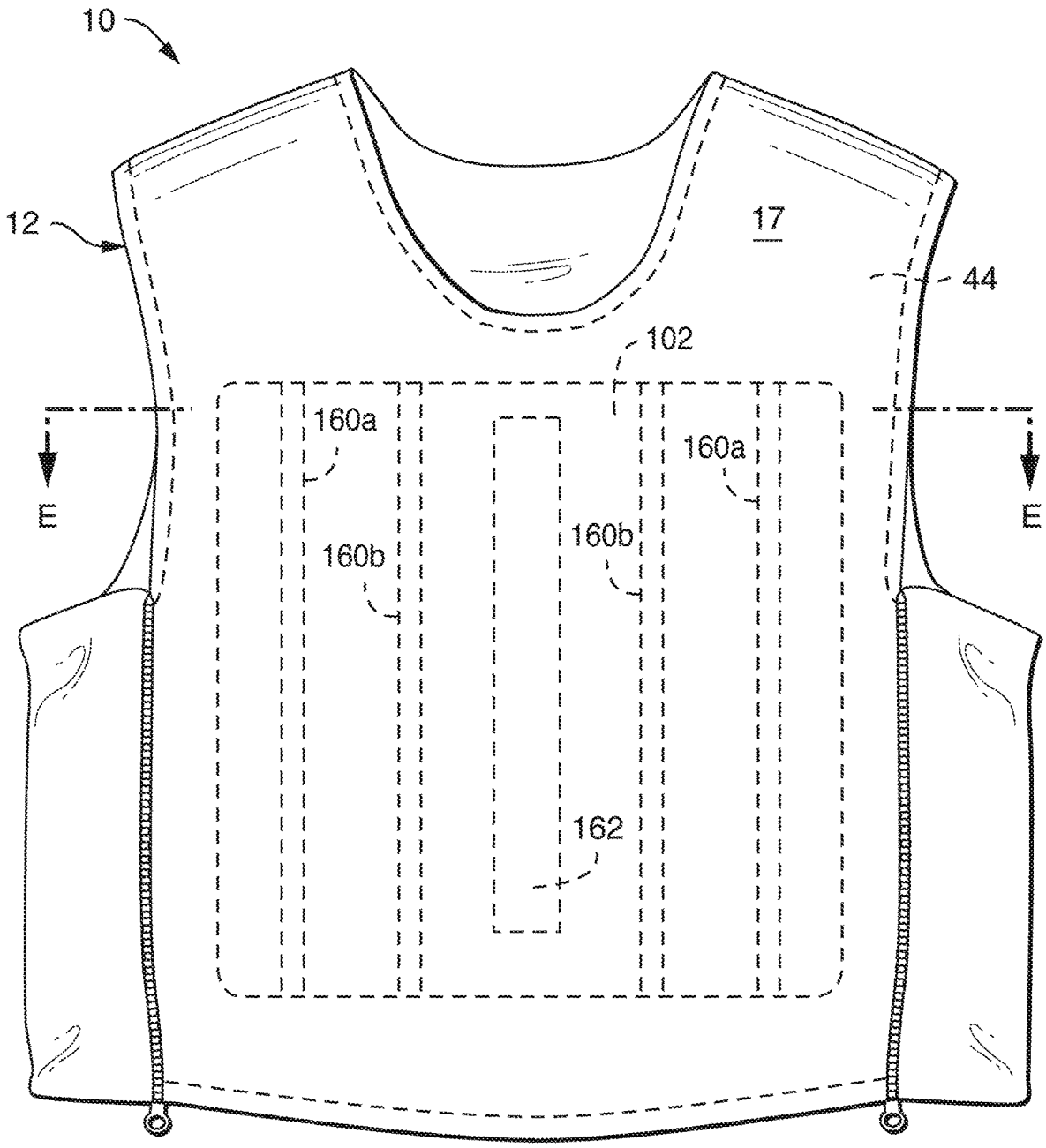
FIG. 18 is a front view of a carrier cover showing the front armor pocket and the front armor pouch with optional sizing strips in phantom and an optional thickness loop fastener in phantom.
Figure 19:
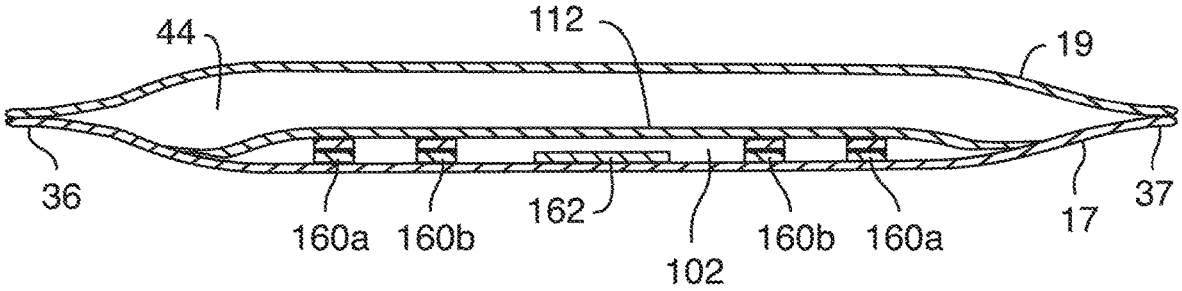
FIG. 19 is a top cross-sectional view of FIG. 18 taken at E-E showing the front armor pocket and the front armor pouch with the optional sizing strips and the optional thickness loop fastener.

In another embodiment, the pouches 102, 104 are intended for use with a variety of armor plates 92, 94 having different widths. To prevent the armor plates 92, 94 from sliding from side to side, the pouches 102, 104 have internal vertical sizing strips 160*a*, 160*b* (collectively, 160), as shown in FIGS. 18 and 19 with the single sheet embodiment of the front pouch 102. The sizing strips 160 come in opposed pairs 160*a*, 160*b* so that the armor plate 92, 94 is kept centered on the torso when installed in the pouch 102, 104. The sizing strips 160 are strips of detachable fasteners, preferably hook and loop fasteners. Other detachable fasteners may be used, such as strips of snaps.

In another embodiment, the pouches 102, 104 are intended for use with a variety of armor plates 92, 94 having different thicknesses. The pouches 102, 104 are sized so that the thickest plate 92, 94 fits snuggly. To prevent the thinner armor plates 92, 94 from sliding around, the pouches 102, 104 each have an internal loop fastener 162, as shown in FIGS. 18 and 19, that mates to a corresponding hook fastener on the plate 92, 94.

Optionally, each pouch 102, 104 can accept more than one armor plate 92, 94 at the same time in the event the wearer wants more protection than is available from a single plate 92, 94.

Optionally, there is a right pouch 106 in the right waist panel 74 and a left pouch 108 in the left waist panel 75 for side armor plates 96, 98, as shown in FIGS. 20-23. The present invention contemplates several configurations for the side pouches 106, 108.

Figure 20:
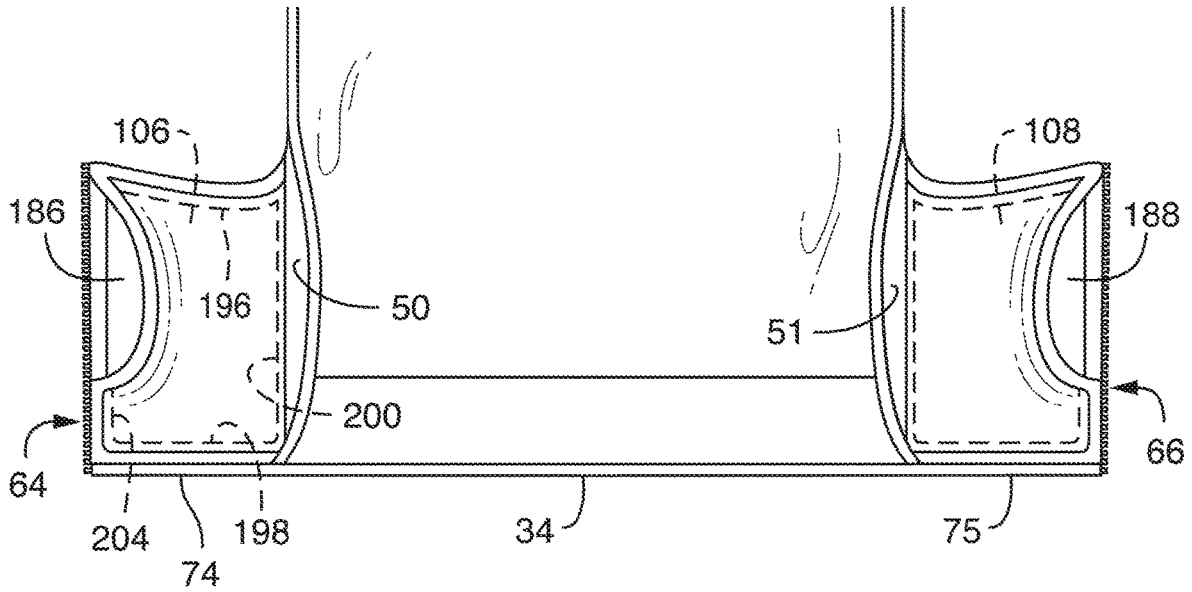
FIG. 20 is a view of the bottom rear of a carrier cover showing a first configuration of the side armor pouches in phantom with a vertical opening.

One configuration of the side pouches 106, 108 is shown in FIG. 20. Referring to the right pouch 106 (the left pouch 108 is the mirror image), the waist panel 74 has an outer layer 192 and an inner layer 194 that are attached at the top edge 196, bottom edge 198, rear edge 200, and the lower portion 204 of the front edge, forming the pouch 106 and a vertical right pouch opening 186 through which the pouch 106 is accessed. The lower portion 204 extends upwardly far enough so that the side armor plate does not fall out after being installed. Consequently, the opening 186 typically does not need an openable fastener. The outer layer 192 and inner layer 194 are preferably composed of a stretch fabric, which provides pressure to retain the armor plate 96 in the pouch 106. The inner layer 194 is preferably composed of a mesh fabric.

The present invention does contemplate, however, the opening 186 may have an openable fastener.

Figure 21:
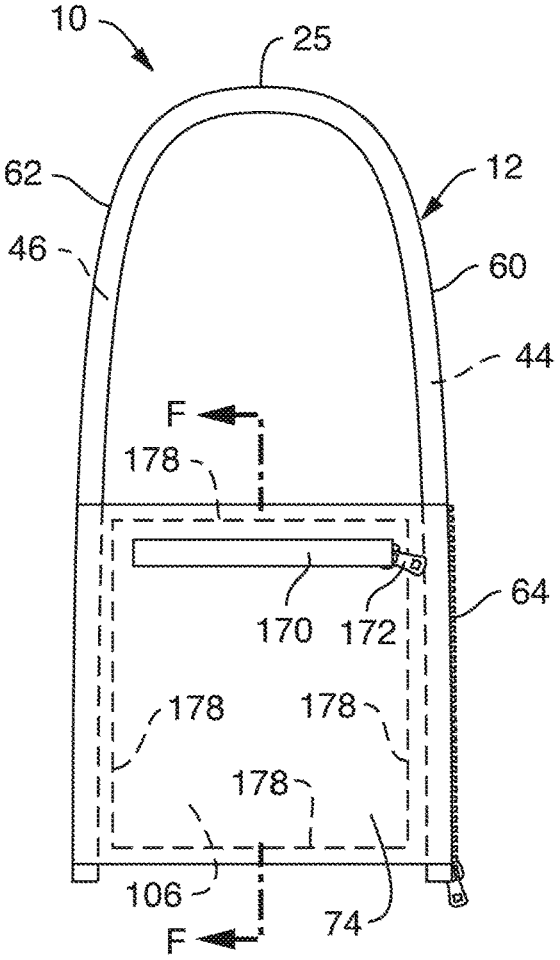
FIG. 21 is a right side view of a carrier cover showing a first configuration of the right side armor pouch in phantom with a closed lateral opening.
Figure 22:
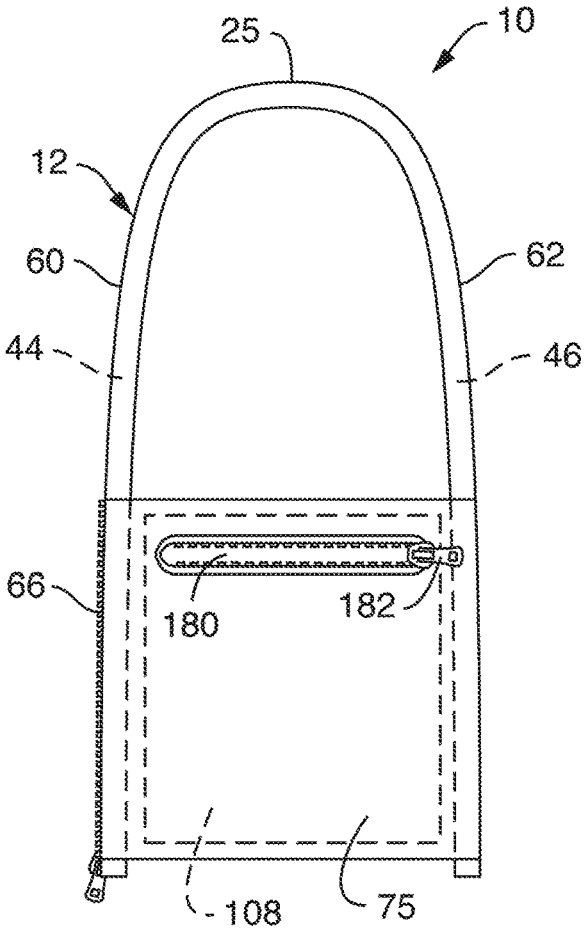
FIG. 22 is a left side view of a carrier cover showing the FIG. 21 configuration of the left side armor pouch in phantom with an open lateral opening.
Figure 23:
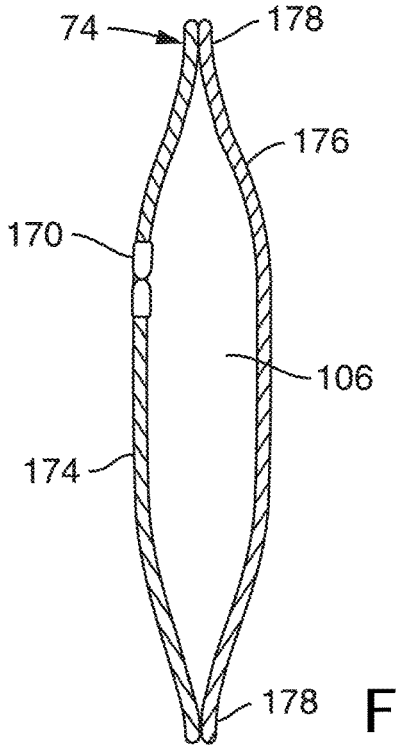
FIG. 23 is a front cross-sectional view of FIG. 21 taken at F-F of the right side armor pouch.

Another configuration of the side pouches 106, 108 is shown in FIGS. 21-23. As shown in FIG. 23, the waist panel 74 has an outer layer 174 and an inner layer 176 that are attached around the edges 178, forming the pouch 106. The top end of the right pouch 106 is accessed via a lateral opening 170 in the outer layer 174 or between the outer layer 174 and inner layer 176 that extends across the right waist panel 74. The lateral opening 170 is optionally closed by an openable fastener 172, such as a zipper, hook and loop fastener or snaps.

The carrier cover 10 is used in two steps. First, the armor panel carriers 40, 42 are installed into the pockets 44, 46, as in FIG. 6, and the shoulder straps 88 are arranged as necessary over the shoulders 25, attaching the front and rear armor panel carriers 40, 42 together. The carrier cover 10 is placed over the wearer's head and the waist straps 86 attach the armor panel carriers 40, 42 together at the waist. Each waist panel 74, 75 is pulled over the waist straps 86 and the fasteners 63, 64 are attached, whereby the waist straps 86 are hidden by the waist panels 74, 75.

At this point, none of the armor plates are installed. The wearer goes about his business, walking, driving, etc.

Figure 24:
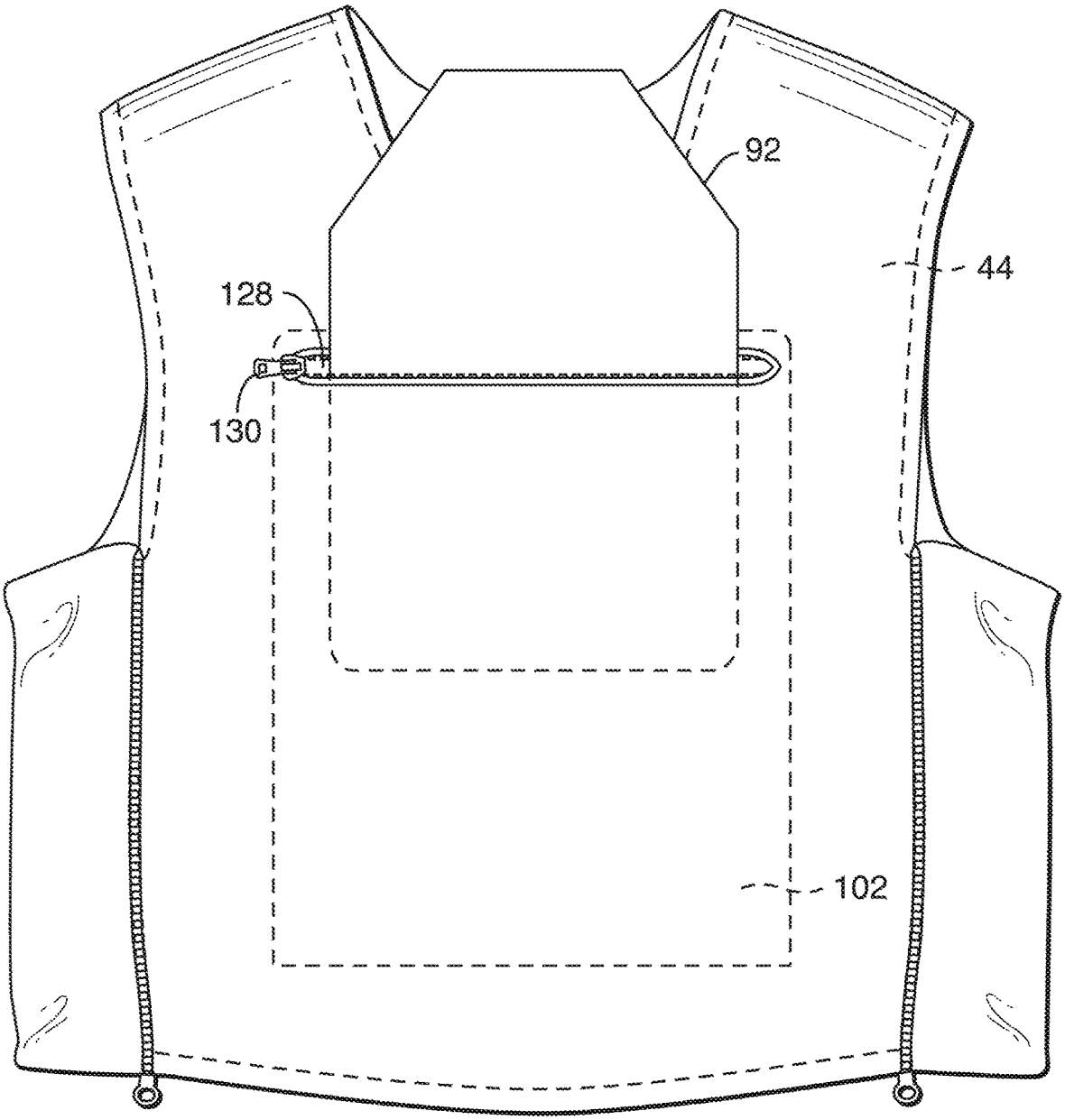
FIG. 24 is a front view in partial phantom of a carrier cover showing a partial installation of a front armor panel into the front pouch through a lateral opening.
Figure 25:
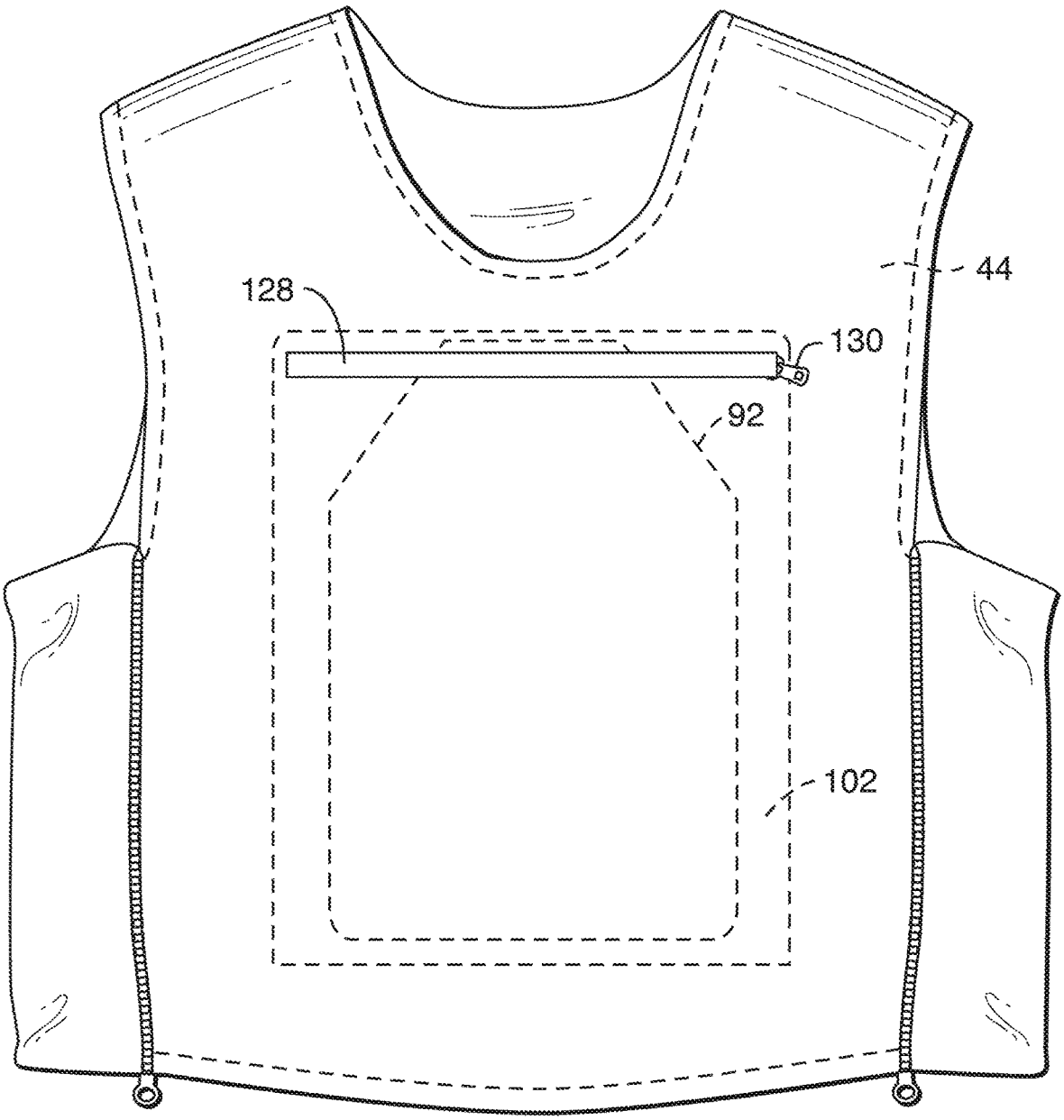
FIG. 25 is a front view in phantom of a carrier cover showing a front armor panel installed the front pouch with a lateral opening.

When a situation arises where the extra protection afforded by the armor plates is desired, the plates can be installed without taking the carrier cover 10 off. The front fastener 130, 136 is opened to gain access to the front pouch 102. The front armor plate 92 is inserted into the front pouch 102, as in FIG. 24, and the fastener 130, 136 is closed, as in FIG. 25.

Figure 30:
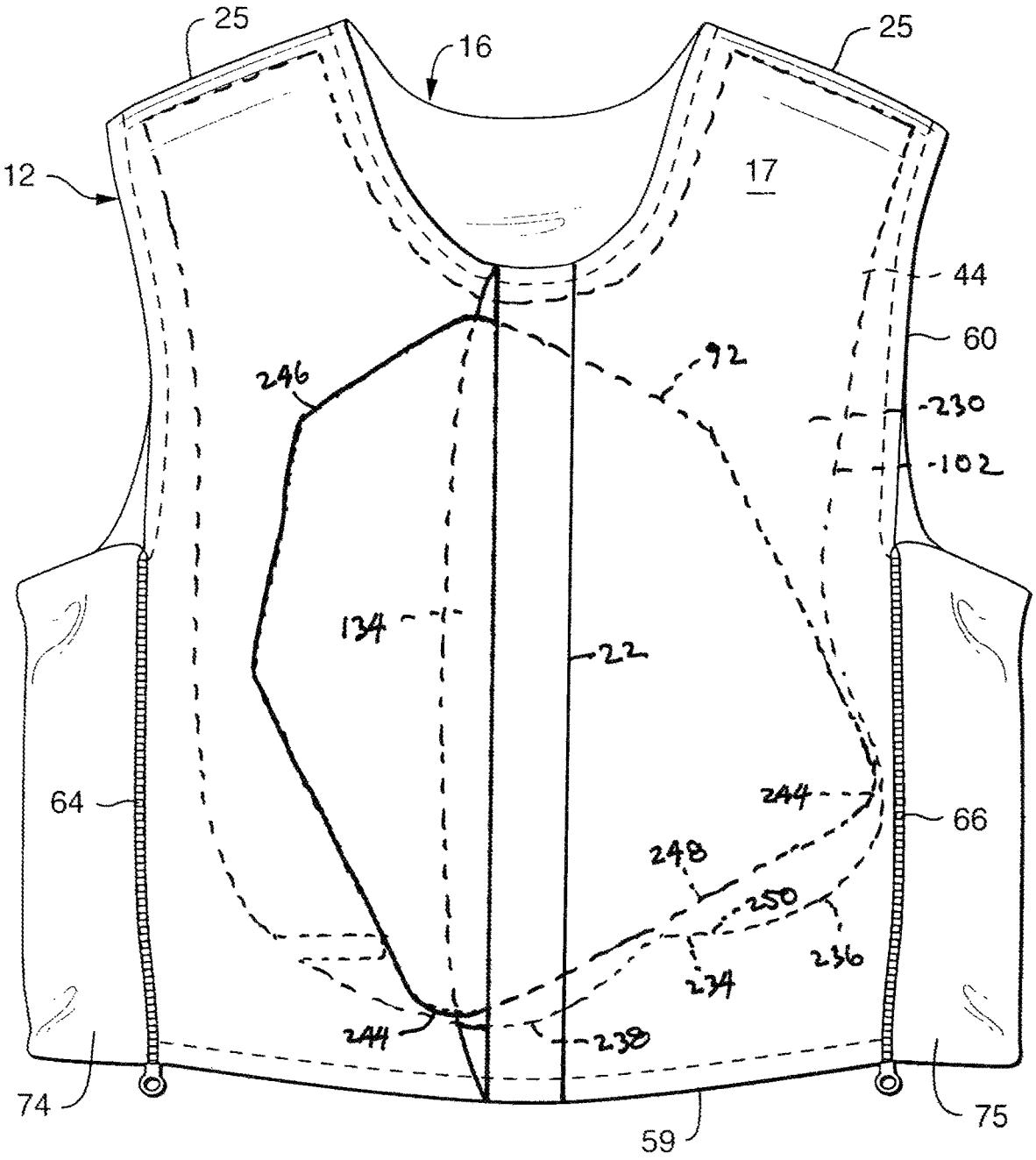
FIG. 30 is a front view of a carrier cover showing a partial installation of a front armor panel into the front pouch through a vertical opening at the placket in partial phantom.
Figure 31:
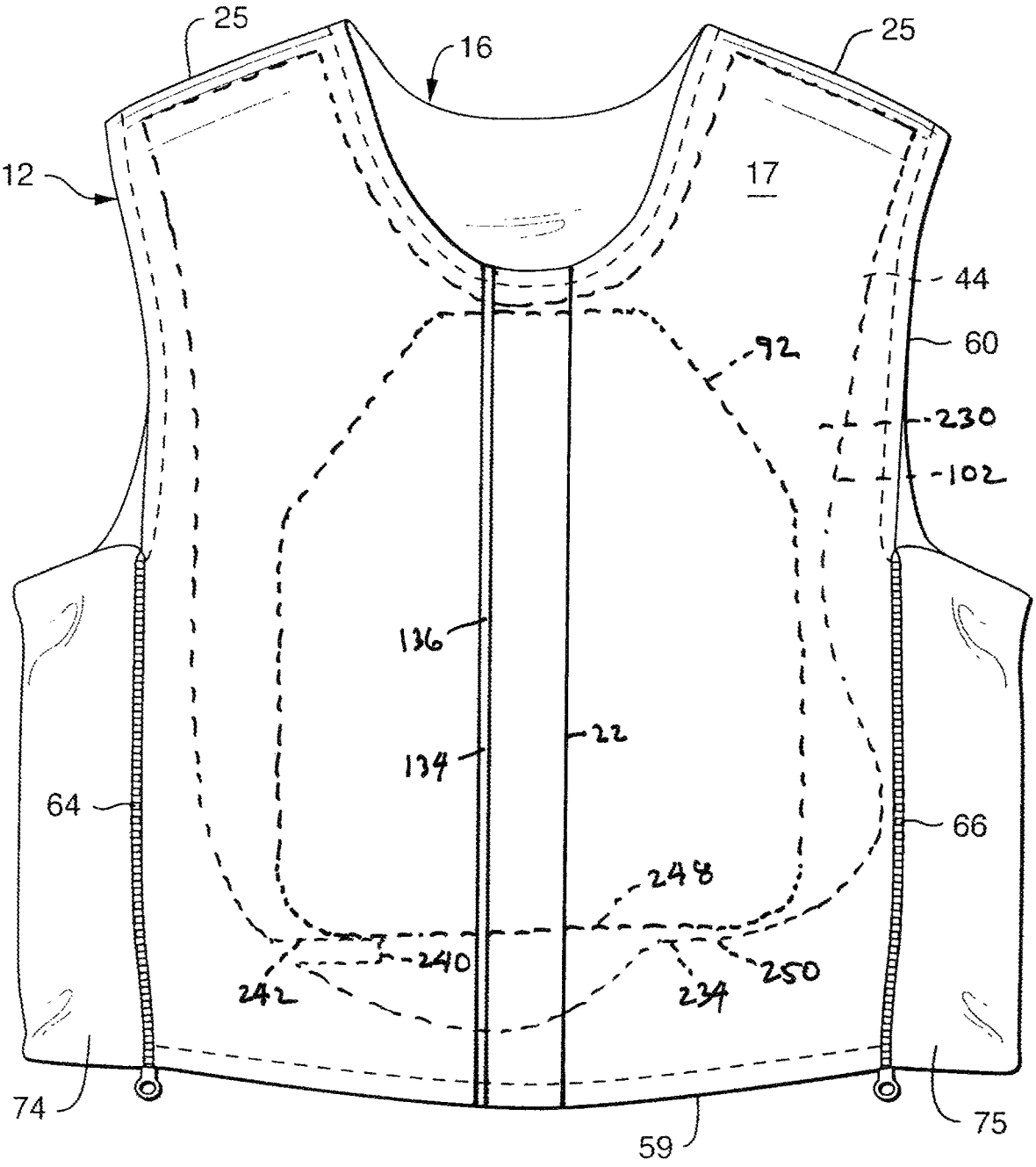
FIG. 31 is a front view of a carrier cover showing a front armor panel installed the front pouch with a vertical opening at the placket in phantom.

To install the armor plate 92 in the front pouch 102 of the shaped bag 230, the front fastener 136 is opened and the front armor plate 92 is inserted diagonally into the opening 134, as in FIG. 30. The two bottom corners 244 of the plate 92 fit into the side lobe 236 and the bottom lobe 238, which extend the size of the pouch 102 for installation. The opening 134 is pulled around the exposed part 246 of the plate 92 until the plate 92 is completely within the pouch 102. The plate 92 is rotated until the plate bottom 248 is resting on the pouch bottom 234 and the top side 242 of the notch 240, as in FIG. 1, and the fastener 136 is closed. As described above, the notch 240 is sewn to the outer layer 17 to provide support for the armor plate 92.

Figure 26:
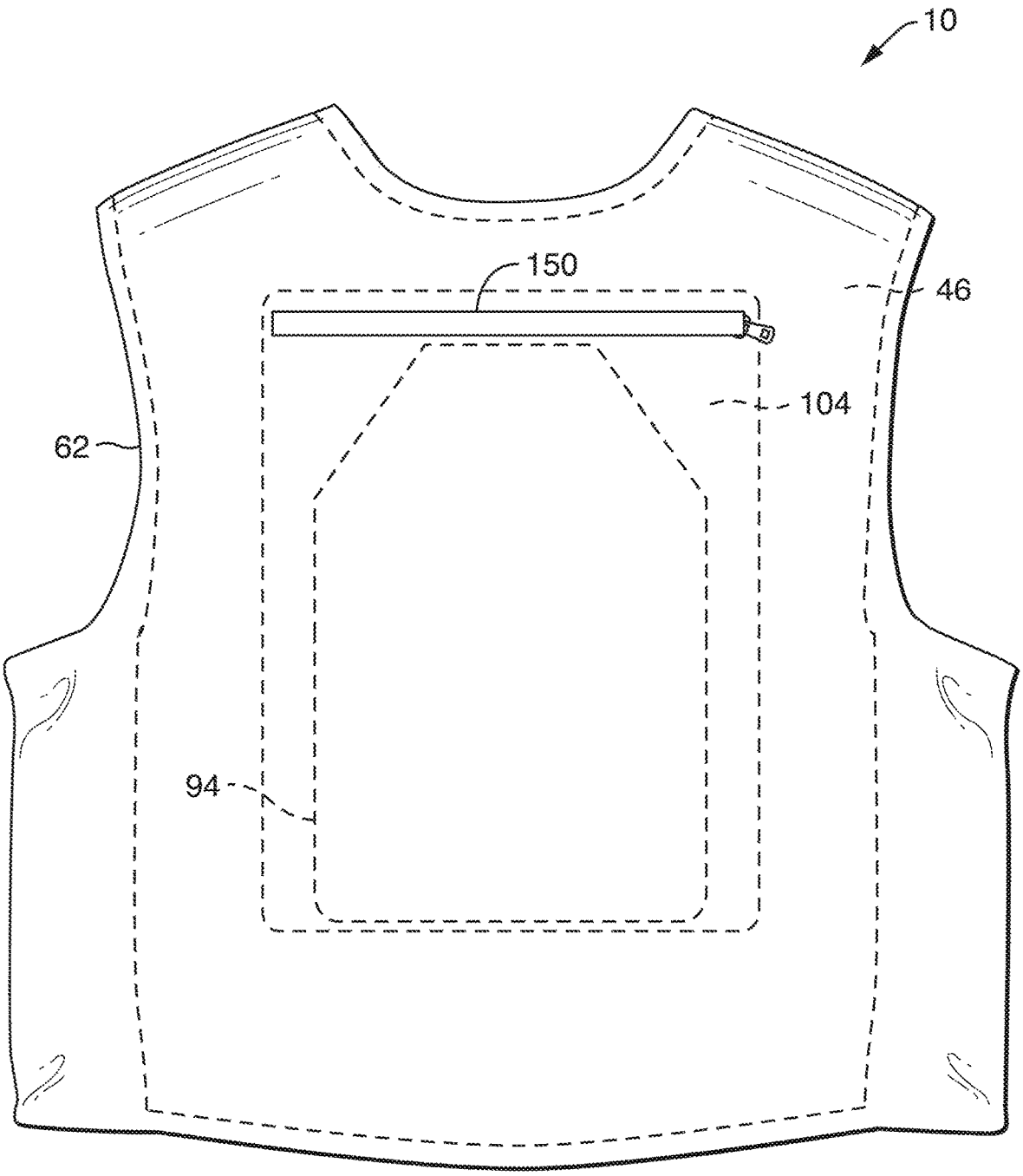
FIG. 26 is a rear view of a carrier cover showing a rear armor panel installed the rear pouch in phantom.

The rear fastener 152 is opened to gain access to the rear pouch 104. The rear armor plate 94 is inserted into the rear pouch 104 and the fastener 152 is closed, as in FIG. 26. If the wearer has a partner, it may be easier for the partner to install the rear armor plate 94.

If the pouches 102, 104 include sizing strips 160, the appropriate strips 160*a*, 160*b* are attached and/or detached to size the pouch 102, 104 to the armor plate 92, 94 that is being used.

Figure 27:
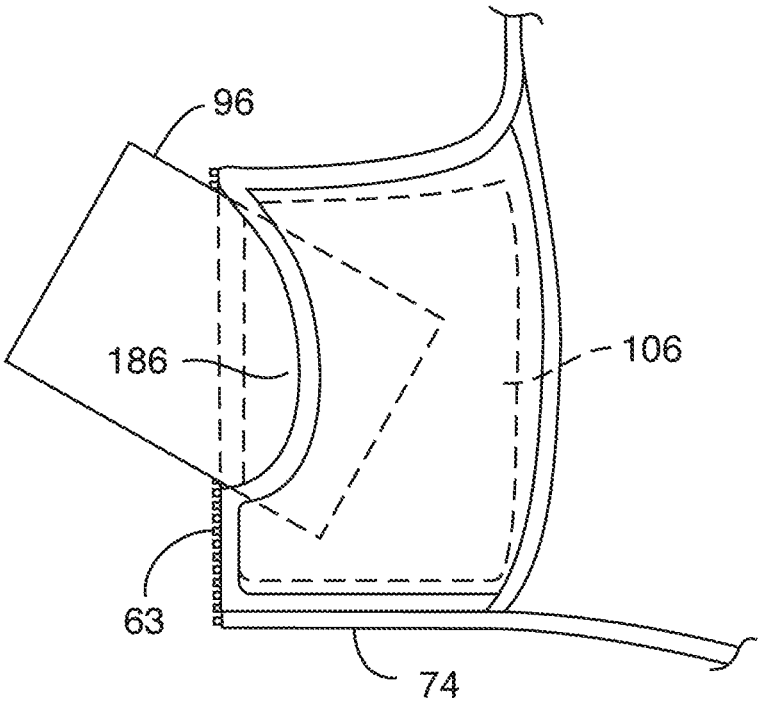
FIG. 27 is a right side view of a carrier cover showing a right side armor panel being installed in the right side pouch in phantom.
Figure 28:
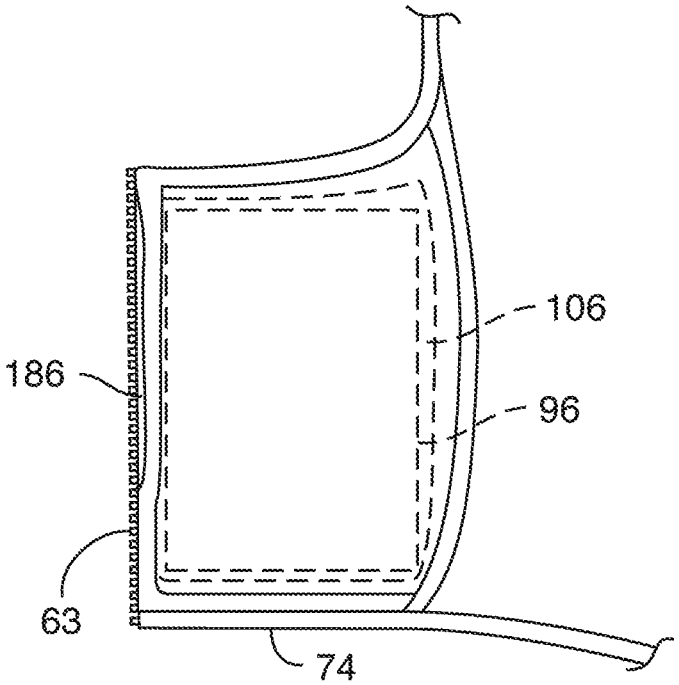
FIG. 28 is a right side view of a carrier cover showing a right side armor panel installed the right side pouch in phantom.

If the carrier cover 10 has the preferred side pouches 106, 108 of FIG. 20, the side panel fasteners 63, 64 are detached to provide access to the inside of the side panels 74, 75. The right side armor pouch opening 186 is pulled open to gain access to the right side armor pouch 106 and the right side armor plate 96 is inserted through the opening 186 into the pouch 106, as in FIGS. 27 and 28. The left side armor plate 98 is inserted into the left side armor pouch 108 through the left side armor pouch opening 188. Then the side panel fasteners 63, 64 are reattached.

The present invention also contemplates that the armor plates can be installed and worn in the normal course of the day. If the armor plates are light enough, they will have only a small effect on the wearer.

Thus it has been shown and described a ballistic vest carrier cover system with pouches for hard armor panels. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A cover for a ballistic vest carrier, the carrier including a front armor panel in a front portion of the carrier, a rear armor panel in a rear portion of the carrier, attachable and detachable waist straps designed to removably attach the front portion of the carrier to the rear portion of the carrier at a waist of a wearer, and attachable and detachable shoulder straps designed to removably attach the front portion of the carrier to the rear portion of the carrier at shoulders of the wearer, the cover comprising:

(a) a mantle extending from a front waist of the mantle through shoulders of the mantle to a rear waist of the mantle and having a neck opening, a right side, and a left side, the mantle having an outer fabric layer and a liner, the liner being attached to the outer fabric layer to form a front pocket and a rear pocket between the outer fabric layer and the liner, the front pocket being accessible through a right front armor opening on the right side of the mantle and through a left front armor opening on the left side of the mantle, the rear pocket being accessible through a right rear armor opening on the right side of the mantle and through a left rear armor opening on the left side of the mantle;

(b) a front pouch inside the front pocket and having a bottom, a first side, and a second side opposite the first side, the front pouch being accessible through a vertical front pouch opening, the front pouch opening closable by an openable front fastener in the outer fabric layer, the front pouch being designed to receive a hard armor panel through the front pouch opening, the bottom of the pouch having a side lobe distending a lower section of the first side of the pouch outwardly, a bottom lobe distending the bottom of the pouch adjacent to the second side downwardly, and a plate support extending horizontally into the pouch from the second side and aligned with the bottom of the pouch at the side lobe;

(c) a rear pouch inside the rear pocket, the rear pouch being accessible through a rear pouch opening closable by an openable rear fastener in the outer fabric layer, the rear pouch being designed to receive a hard armor panel through the rear pouch opening;

(d) whereby the front armor portion of the carrier is inserted into the front pocket, the rear armor portion of the carrier is inserted into the rear pocket, and the front portion of the carrier is attached to the rear portion of the carrier by one of the waist straps through the right front armor opening and the left front armor opening, the other waist strap through the right rear armor opening and the left rear armor opening, and by the shoulder straps.

2. The ballistic vest carrier cover of claim 1 wherein the front pouch opening is behind or at the edge of a placket.

3. The ballistic vest carrier cover of claim 1 wherein the front pouch is a bag with an upper end attached to the outer fabric layer and hanging within the front pocket.

4. The ballistic vest carrier cover of claim 1 wherein the front pouch is formed by a single sheet attached to the outer fabric layer within the front pocket.

5. The ballistic vest carrier cover of claim 1 wherein the rear pouch is formed by a single sheet attached to the outer fabric layer within the rear pocket.

6. The ballistic vest carrier cover of claim 1 wherein the rear pouch is a bag with an upper end attached to the outer fabric layer and hanging within the rear pocket.

7. The ballistic vest carrier cover of claim 1 wherein the rear pouch opening is horizontal.

8. The ballistic vest carrier cover of claim 1 wherein the front pouch is composed in part of a mesh fabric.

9. The ballistic vest carrier cover of claim 1 wherein the rear pouch is composed in part of a mesh fabric.

10. The ballistic vest carrier cover of claim 1 further comprising:

(a) a right waist panel extending from the outer fabric layer at the right rear armor opening to a free end that is removably attachable to the outer fabric layer at the right front armor opening, the right waist panel having an inner layer attached to an outer layer forming a right pouch therebetween, the right pouch being accessible through a right pouch opening, the right pouch designed to receive a hard armor panel through the right pouch opening; and (b) a left waist panel extending from the outer fabric layer at the left rear armor opening to a free end that is removably attachable to the outer fabric layer at the left front armor opening, the left waist panel having an inner layer attached to an outer layer forming a left side pouch therebetween, the left pouch being accessible through a left pouch opening, the left pouch designed to receive a hard armor panel through the left pouch opening.

11. The ballistic vest carrier cover of claim 10 wherein the waist panels are composed substantially of a stretch fabric.

12. The ballistic vest carrier cover of claim 10 wherein the side pouch openings are lateral.

13. The ballistic vest carrier cover of claim 10 wherein the side pouch openings are vertical.

* * * * *